US007207147B2

(12) United States Patent
Price et al.

(10) Patent No.: US 7,207,147 B2
(45) Date of Patent: Apr. 24, 2007

(54) MORTARLESS WALL STRUCTURE

(75) Inventors: Raymond R. Price, Rochester, MN (US); Gerald P. Price, Rochester, MN (US)

(73) Assignee: Alliance Concrete Concepts, Inc., Rochester, MN (US)

( * ) Notice: Subject to any disclaimer, the term of this patent is extended or adjusted under 35 U.S.C. 154(b) by 0 days.

(21) Appl. No.: 10/363,999

(22) PCT Filed: Apr. 12, 2001

(86) PCT No.: PCT/US01/11957

§ 371 (c)(1),
(2), (4) Date: Feb. 28, 2003

(87) PCT Pub. No.: WO01/79620

PCT Pub. Date: Oct. 25, 2001

(65) Prior Publication Data

US 2004/0006945 A1 Jan. 15, 2004

(30) Foreign Application Priority Data

Sep. 20, 2000 (WO) ..... PCT/US00/25791

(51) Int. Cl.
*E04B 2/00* (2006.01)

(52) U.S. Cl. ..... 52/586.1; 52/574

(58) Field of Classification Search ..... 52/DIG. 3, 52/586.1, 477, 749, 588.1, 592.1, 585.1, 52/592.2, 563, 169.12, 574, 764, 762, 481.1
See application file for complete search history.

(56) References Cited

U.S. PATENT DOCUMENTS 1,509,424 A 9/1924 Garrard
1,548,214 A 8/1925 Schaefer et al.
1,592,476 A * 7/1926 Torrecelli ..... 52/125.3
2,066,205 A 12/1936 Keating
2,158,732 A 5/1939 Shannon
2,162,695 A 6/1939 Boyd
2,392,551 A * 1/1946 Roe ..... 52/586.2
2,703,004 A 3/1955 Kenedy
2,787,812 A 4/1957 Long
3,114,220 A 12/1963 Maddox et al.
3,381,437 A 5/1968 Kidney (Continued)

FOREIGN PATENT DOCUMENTS

GB 2264728 A 9/1993

(Continued)

*Primary Examiner*—Jeanette Chapman
*Assistant Examiner*—Jessica Laux
(74) *Attorney, Agent, or Firm*—Moore & Hansen, PLLP

(57) ABSTRACT

A wall structure (10, 110) and method of construction. The wall structure (10, 110) comprises a plurality of preformed, lightweight blocks (12, 112) supported and interconnected by a plurality of elongated, vertically oriented, collateral support beams (16, 116). Preferably, the support beams (16, 116) are operatively connected to an appropriate substructure (62, 100) and the lightweight blocks (12, 112) are operatively connected to the support beams (16, 116). The blocks (12, 112) and support beams (16, 116) are configured so that when they are connected to each other, a space is formed between the wall structure (10, 110) and the substructure (62, 100). Thus, an assembled wall structure (10) may be setoff from a substructure and the substructure (62, 100) may be used for other purposes.

25 Claims, 11 Drawing Sheets

U.S. PATENT DOCUMENTS

| | | | | | |
|---|---|---|---|---|---|
| 3,412,515 | A | | 11/1968 | Finon | |
| 3,427,771 | A | | 2/1969 | Cacossa | |
| 3,608,928 | A | | 9/1971 | Hooker | |
| 3,859,765 | A | * | 1/1975 | Nelsson | 52/241 |
| 3,888,055 | A | | 6/1975 | Gallo | |
| 4,057,947 | A | * | 11/1977 | Oide | 52/779 |
| 4,214,412 | A | | 7/1980 | Barylski | |
| 4,408,427 | A | * | 10/1983 | Zilch | 52/481.2 |
| 4,443,991 | A | | 4/1984 | Mieyal | |
| 4,549,378 | A | | 10/1985 | Ayers et al. | |
| 4,641,469 | A | | 2/1987 | Wood | |
| 4,656,797 | A | | 4/1987 | Marquart | |
| 4,674,593 | A | | 6/1987 | McCarty | |
| 4,738,061 | A | | 4/1988 | Herndon | |
| 5,098,328 | A | * | 3/1992 | Beerens | 446/128 |
| 5,291,711 | A | | 3/1994 | Kopaz | |
| 5,337,530 | A | * | 8/1994 | Beames | 52/426 |
| 5,363,620 | A | | 11/1994 | Liu | |
| 5,501,050 | A | | 3/1996 | Ruel | |
| 5,688,078 | A | | 11/1997 | Hammer | |
| 5,704,180 | A | * | 1/1998 | Boeck | 52/426 |
| 5,775,046 | A | * | 7/1998 | Fanger et al. | 52/590.1 |
| 5,787,669 | A | * | 8/1998 | Bishop | 52/591.4 |
| 5,984,044 | A | | 11/1999 | Christensen | |
| 6,125,597 | A | | 10/2000 | Hoffman et al. | |
| 6,170,214 | B1 | * | 1/2001 | Treister et al. | 52/511 |
| 6,318,041 | B1 | * | 11/2001 | Stanley | 52/505 |
| 6,374,552 | B1 | * | 4/2002 | Price | 52/169.12 |
| 6,675,545 | B2 | * | 1/2004 | Chen et al. | 52/586.1 |
| 6,695,544 | B2 | * | 2/2004 | Knudson et al. | 405/284 |
| 6,986,934 | B2 | * | 1/2006 | Chen et al. | 428/195.1 |
| 2002/0026760 | A1 | * | 3/2002 | Moore | 52/309.11 |

FOREIGN PATENT DOCUMENTS

| | | |
|---|---|---|
| JP | 40-6158814 | 6/1994 |
| WO | WO 01/79620 A1 | 10/2001 |

* cited by examiner 14
14
14
10
4
12
4
12
5
5

28a
34
24
12
22
34
32
20
21

36
38b
42
40
40
16
38a
28b 26
30
42
14
48
50
10
45
46
44
18
47
12
34
12
16
12
34

12
24
16
12
24
22
22
34
34
30
21
20
28a
28b
21
20
14
14

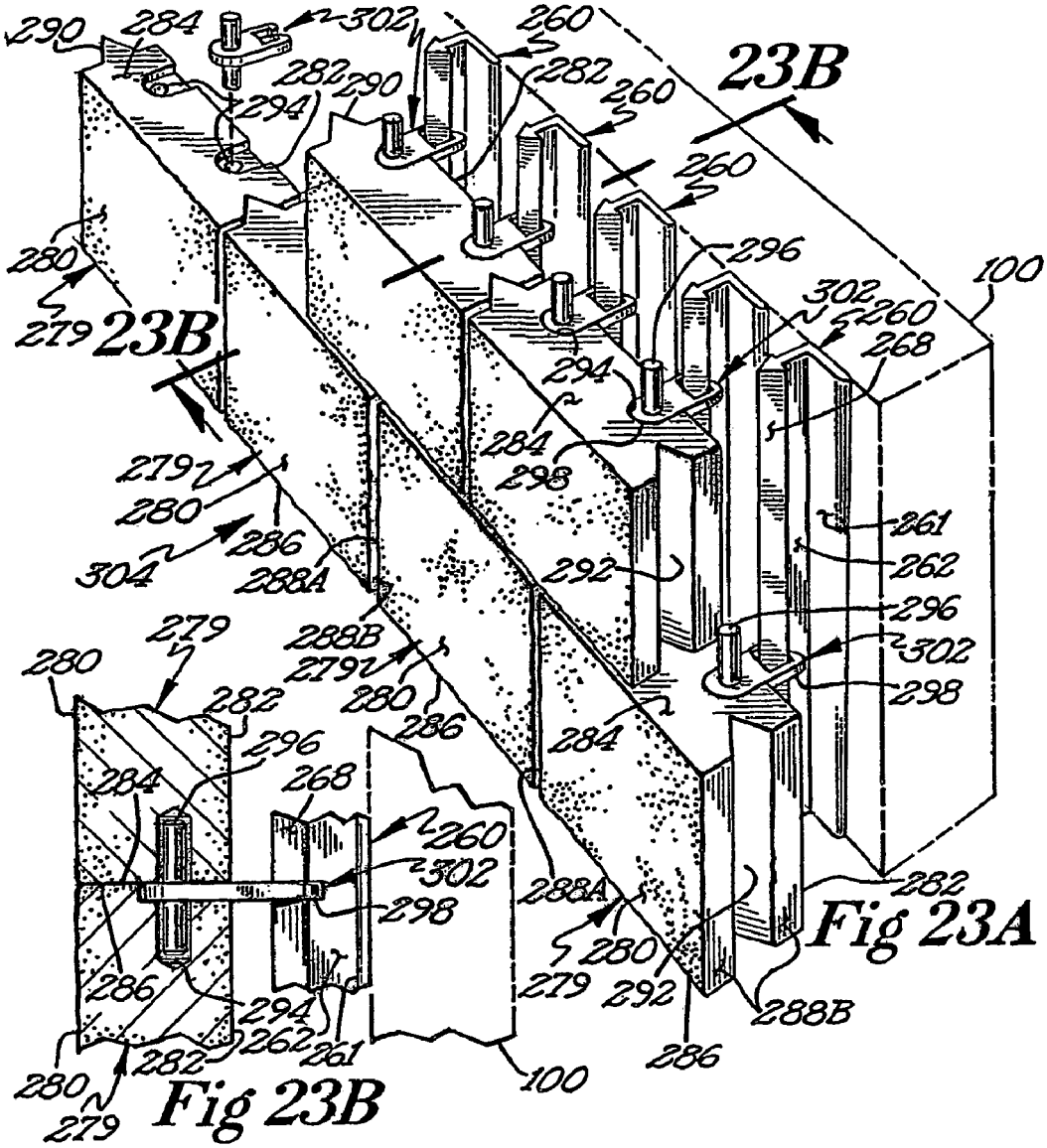
Fig 23A
Fig 23B
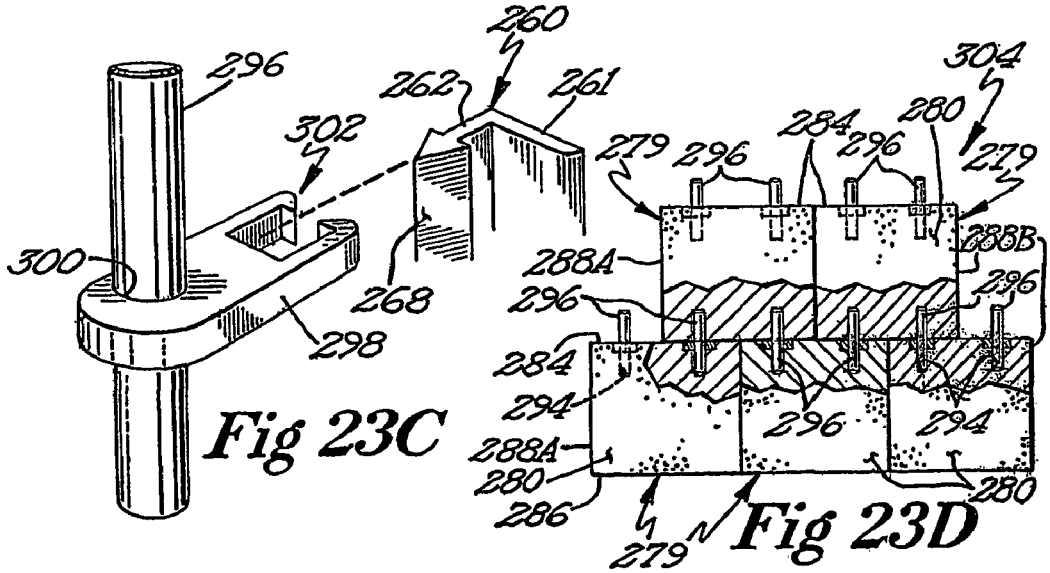
Fig 23C
Fig 23D

MORTARLESS WALL STRUCTURE

BACKGROUND OF THE INVENTION

The present invention is drawn to a wall structure that may be adapted for use in many applications. Specifically, the present invention is a wall structure that may be used in a variety of interior and exterior applications, for example, as a skirting wall, as wainscoting, as a small retaining wall, as a pool wall, as a veneer or fascia, as cladding or siding, as a fence, and as a load-bearing or non load-bearing wall.

Transportable structures such as mobile homes, trailer homes, modular homes and recreational vehicles are usually not built upon a conventional foundation. Rather, they are brought or driven to a location where they remain for indeterminate periods of time. Often, over an extended period at a particular site, such structures may start to settle onto or in the ground due to factors such as deflating tires or weight of the structure. Or, settling may be the result whether related factors such as erosion and freeze-thaw cycles. As a result, such structures may shift and/or sink. In order to prevent shifting and sinking of these structures, and moreover to ensure the structure is level regardless of the ground's topography, they are usually placed on stilts or supports that extend from the ground and elevate the structure thereabove. While this solves the aforementioned problem of shifting and/or sinking, it causes an unsightly visible gap in the area between the ground and the bottom of the structure.

Various attempts to cover the unsightly visible gap have included the use of plants, rocks, wood, plastic and masonry blocks. These structure skirting efforts were either prohibitively expensive, difficult to install, or unattractive and unable to withstand sustained exposure to nature's elements. Solutions that tend to be prohibitively expensive or difficult to install include large, custom-made, cement slabs having a decorative face, and the use of standard cinder blocks and mortar to build a wall around the bottom of the structure. Attempts that fall into the latter category include such easily breakable products as wooden or plastic lattices and plastic or foam panels that imitate a stone or brick wall. Consequently, there is a need for a sturdy, inexpensive, easily assembled wall structure for skirting a transportable structure such as a mobile home.

In other applications, where brick, stone, or concrete is used as veneer or fascia, for fencing, and as load-bearing and non load-bearing walls, these structures are typically non-transportable and permanent in nature. That is, the component parts are assembled as part of a larger structure that are not intended to be easily dismantled. With veneer, for example, a substantial portion of the rearwardly facing surface is typically coated with adhesive or cementatious material to enable the veneer to be securely and directly bonded to a structure. As another example, walls may be constructed in a conventional manner with blocks and mortar, or they may comprise heavy blocks that interlock with each other without the use of mortar. As one may well imagine, it is very difficult and time consuming to reconfigure, remove or repair such structures. In addition, the erection of these structures typically requires specialized knowledge and skills to achieve. In light of these shortcomings, there is an additional need for a wall structure that may be easily assembled, disassembled and rebuilt or reconfigured by an unskilled user without damage to the constituent parts of the wall structure and which may be used as a veneer, fascia, cladding, fence, or as a load-bearing or non load-bearing wall.

SUMMARY OF THE INVENTION

One embodiment of the present invention provides a composite masonry block and wall system to be used to skirt elevated structures. The block is shaped to be stacked in vertically independent columns, held in place by specially shaped, lightweight, support beams placed between adjacent columns, and also by U-shaped lateral supports which open downwardly and are attached to the bottom of the elevated structure.

Preferably, the blocks comprise a split front face, a rear face, top and bottom surfaces, and side surfaces. The side surfaces include grooves for receiving supporting portions of the support beams. The top and bottom surfaces are preferably shaped so that when an upper block is stacked on a lower block, the lower surface of the upper block sits on the upper surface of the lower block and the two blocks are relatively coplanar and vertical. This configuration is most easily accomplished using blocks having flat top surfaces and flat bottom surfaces that are relatively perpendicular to the front and rear faces. It would also be possible to accomplish this vertical block-to-block relationship using top and bottom surfaces comprised of complementary angles and/or curves.

The support beams are preferably a weather resistant metal or plastic, nylon or other synthetic, durable, inexpensive material, such as poly-vinyl chloride (PVC). The purpose of the beams is to keep the independent vertical columns from buckling when subjected to a force normal to the plane of the wall. The rigidity of the blocks provides enough support to prevent failure in other directions. This purpose may be accomplished using relatively thin beams having lateral extensions for being received by the grooves in the sides of the blocks.

Preferably, the beams serve to stabilize and maintain the blocks in independent vertical columns and they provide little or no support in the vertical direction. The columns are considered independent because, unlike conventional brick or stonewalls, one horizontal course of blocks is aligned with the adjacent upper and lower courses so that the blocks in each course are in line with the blocks above and below them, as opposed to being laterally offset. This results in the formation of vertical columns of blocks that can move up and down, due to forces exerted by the ever-shifting earth, without upsetting, or otherwise exerting forces on, adjacent columns of blocks.

The resulting wall of this system is surprisingly strong. It may even be used to provide support to the elevated structure. Once installed the elevated structure may be lowered onto the blocks. Alternatively, the blocks may merely serve as a skirt, which improves the aesthetics of the structure and keeps unwanted birds and animals from nesting or otherwise residing under the structure. In this embodiment, it is not necessary that the blocks make actual contact with the structure.

The use of the lateral support beams also obviates the need for mortar between the blocks. This mortarless system is advantageous over traditional brick and mortar walls for obvious reasons. First, fewer materials are required to build a wall. Thus the cost of transporting the materials to a site is reduced. Second, great physical strength and stamina are not required because the materials used are lighter. Moreover, since less stamina is required, a person is able to work for longer periods of time without breaks. And, because of the relative lightness of the materials used, on the job injuries due to overexertion and/or fatigue are reduced. Third, no special skills are required to construct a mortarless wall structure. Fourth, a mortarless wall structure may be constructed by one person. Thus the need for an additional person to mix and deliver mortar at a site is eliminated—further reducing cost of construction. Fifth, since there are no time constraints imposed by drying mortar, a person can construct a wall at their own pace. Sixth, a mortarless wall structure may be constructed under conditions, which, for a conventional block and mortar wall, would be extremely difficult or impossible. Also, the loose block system may be constructed on a wide variety of surfaces, including soils such as sand, gravel, or dirt, concrete, or construction elements such as wood or steel beams, flooring, sills, thresholds, etc.—it is not necessary to pour a foundation.

The lateral support beams also allow the use of relatively thin blocks. These thin, wafer-like blocks are relatively lightweight, resulting in ease of handling and shipping, and a reduction in material costs. The blocks are preferably between 1 and 4 inches (2.5–10 cm.) thick, more preferably on the order of 2½ inches (6.0 cm.) thick. As they are generally between 6 and 12 inches (15–30 cm.) in height and between 6 and 24 inches (15–60 cm.) in width, it would be difficult to use such a tall thin block to create a brick wall using mortar. The tall, thin blocks would have to be held in place somehow to allow the mortar to dry. However, tall thin blocks provide certain advantages and the present invention provides a way of incorporating the advantageous of such a block. These advantages include an increased front face surface area, resulting in a more attractive wall. The design also provides increased lateral support, ideal for use with such a beam system.

The loose block system also allows the wall to be disassembled and reassembled. This not only gives flexibility during initial construction, but also allows later renovations to be made easily and inexpensively. For instance, may be desirable to vent wall structures such as skirting walls to prevent the buildup of moisture or condensation between the ground and the elevated structure. These vents can be easily installed into an existing wall, especially if they are of similar dimensions and configurations as the blocks. The blocks of a given column are simply removed and reinstalled, replacing one of the blocks with the vent. Other auxiliary items, such as an access door or lights, could be installed in a similar manner.

The wall design of the present invention also allows a wall corner to be constructed without supporting beams or mortar. Two walls are simply aligned to form a butt joint and fasteners such as appropriate plastic pegs or screws and plastic inserts are used to fasten one wall to the other. Alternatively, construction mastic, or a similar type of adhesive, may be applied instead of or in combination with the screws. Again, ease of installation is greatly improved by the loose block, mortarless system of the present invention.

Another embodiment of the present invention is well suited for use as a veneer or as wainscoting. In this embodiment, the support beam also includes one or more leg structures that extend from the support beam toward a structure over which the wall structure will be applied as a veneer. The leg structure comprises a leg and a foot that are preferably arranged at right angles to one another and to the support beam, but which may be constructed at any appropriate angle.

A double-ended support beam is useful in adapting the wall structure of the present invention to the creation of a double-sided wall. In this embodiment of the present invention, two block engaging structures comprising a web and at least one rib extending therefrom are coupled together in a spaced apart relationship by a spacer or web. The respective block engaging structures engage the grooves between the side edges of adjacent block columns of respective wall faces to couple the wall faces together.

Another embodiment of the support beam of the present invention is useful in constructing walls having a single face. In this embodiment, the support beam comprises a block engaging structure that extends from a solid or hollow elongate post. The block engaging structure of this support beam preferably comprises a web having extending therefrom a pair of ribs that are constructed and arranged to engage the opposing grooves formed in the side surfaces of adjacent block columns in the wall face. The post portion of this support beam can be secured directly to a wall support structure such as a foundation, footing, ledge, or bracket. Where the post portion of the support beam is hollow, the support beam can be slipped over a structural member that is secured directly to a wall support structure such as a foundation, footing, ledge, or bracket.

In another embodiment of the support beam, the web includes an extension portion and an attachment member that may be operatively connected to a substructure by fastening elements, adhesive, clips, or two-part fasteners, for example. When the attachment member is operatively connected to a substructure, the extension portion positions the ribs of the support beam (and hence the blocks of the support wall) away from the substructure in a spaced relation. The setoff provided by this embodiment greatly increases the number of uses of the wall structure because the space between the wall structure and the substructure is now available for other uses such as conduits, plenums, additional insulation, etc. The blocks used in this embodiment are preferably symmetrical and may be reversed, if desired.

Another embodiment of the wall structure uses elongated blocks that have been provided with one or more transverse channels that are configured to operatively engage a support beam which, in turn, is operatively connected to a substructure. The elongated blocks may also be provided with complimentarily shaped projections and recesses at opposing sides that serve to align adjacent blocks and strengthen the wall structure. As with the previous embodiment, a wall structure using these blocks may be setoff from the substructure to which it is operatively connected and the space therebetween may be available for other uses.

Still another embodiment of the wall structure uses elongated blocks that are operatively connected to each other by a plurality of pegs that are operatively connected a substructure by webs, and support beams. These elongated blocks are also provided with complimentarily shaped projections and recesses at opposing sides that serve to align adjacent blocks and strengthen the wall structure. As with the previous embodiment, a wall structure using these blocks may also be setoff from the substructure to which it is operatively connected and the space therebetween may be available for other uses.

A final embodiment of the wall structure includes a support beam having forwardly facing, viewable surface. The viewable surface may be provided with a surface which is similar to the blocks it is retaining, or it may be provided with a contrasting surface. Alternatively, the viewable surface of the support beam may be provided with an additional cap or strip of material similar to that of the blocks of the wall structure, and the cap or strip may be otherwise textured or modified. The blocks used in conjunction with this support beam include single opposing, laterally extending, aligned fingers that are offset from the center plane of the blocks in an coplanar relation and which enable the blocks to be operatively connected to a support beam or beams in several orientations. The blocks have front and rear faces which may have similar or different surface textures and designs. As with the earlier described embodiment the blocks may be reversed if desired, so that either the front face or the rear face may be viewed. With the support beam and block of this embodiment, a wide variety of visually distinctive surfaces as well as a conventionally configured surfaces are possible.

These and other objectives and advantages of the invention will appear more fully from the following description, made in conjunction with the accompanying drawings wherein like reference characters refer to the same or similar parts throughout the several views. And, although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

DESCRIPTION OF THE DRAWINGS

FIG. 23A is a perspective view of another preferred embodiment of support beams and blocks used to construct a wall structure of the present invention;

FIG. 23B, is a partial, side view of an embodiment of a web and a support beam that may be used to operatively connect blocks of the wall structure of FIG. 23A to a substructure;

FIG. 23C is a partial, exploded perspective view of an embodiment of a web and a support beam that may be used to operatively connect blocks of the wall structure of FIG. 23A to a substructure;

FIG. 23D is a partial plan view illustrating apertures and pegs of the wall structure of FIG. 23A;

DETAILED DESCRIPTION

Figures 1, 2, 3, 4, 5:
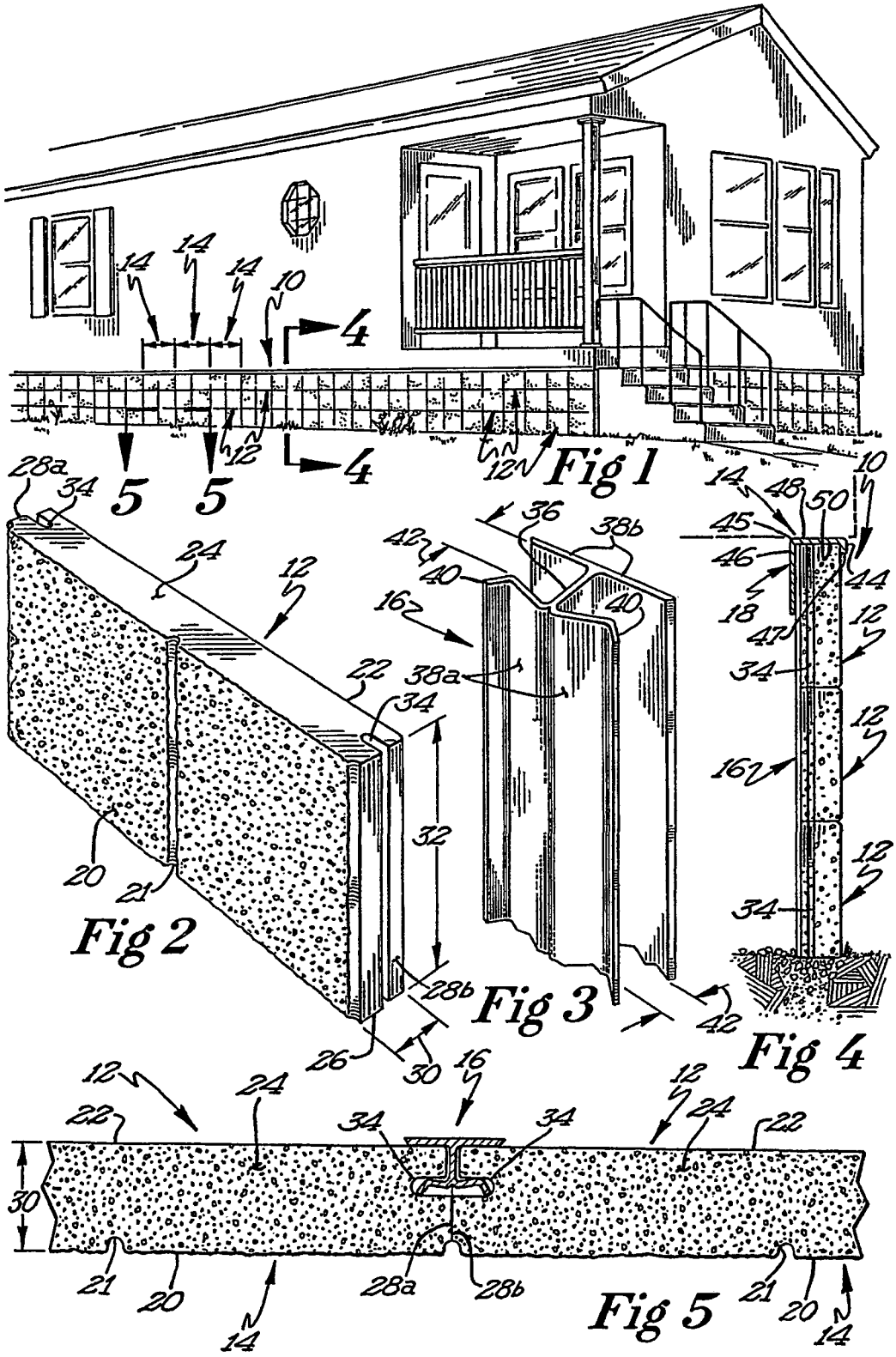
FIG. 1 is a perspective view of an elevated structure skirted with an embodiment of the wall structure of the present invention.
FIG. 2 is a perspective view of an embodiment of a block of the present invention.
FIG. 3 is a perspective view of an embodiment of a support beam of the present invention.
FIG. 4 is a side elevational view of a column of the present invention taken generally along lines 4—4 of FIG. 1.
FIG. 5 is a plan view, taken generally along lines 5—5 of FIG. 1, of two adjacent blocks of the present invention abutted and held by a support beam.

Referring now to the drawings and first to FIGS. 1–4, there is shown a wall structure 10 comprised of a plurality of blocks 12 forming columns 14 partially spaced apart and held in place by vertically oriented, lateral support beams 16. Downward opening brackets 18 attached to the bottom of the structure being skirted, are placed over the top block 12 of selected columns 14 to help prevent wall 10 from tipping rearwardly or forwardly. As used herein, the term "forward" means away from the center of the elevated structure and the term "rearward" means toward the center of the elevated structure.

Attention is now directed to the individual components of wall system 10. FIG. 2 depicts a preferred embodiment of block 12. It can be seen that block 12 generally comprises a front face 20, a rear face 22, a top surface 24, a bottom surface 26 and side surfaces 28A and 28B. Block 12 is preferably made of a dry composite masonry material, which hardens quickly when compressed in a mold. It is envisioned that other materials could be used, such as concrete, fiberglass, ceramics, hard plastics, or dense foam. The present invention would also be achieved if blocks 12 were formed of wood, preferably treated wood. Though the general shape of the blocks is more important to achieve the present invention than the material used, it has been found that the aforementioned preferred dry composite masonry material provides the most desirable combination of strength, appearance, economy, and ease of manufacturing.

Front face 20 is forwardly spaced from rear face 22 by a predetermined distance herein defining the depth 30 of block 12. As shown in FIG. 2, it is envisioned that front face 20 is formed using a splitting process, thereby forming an attractive, roughened face. This, however, is not necessary to carry out the spirit of the invention. Front face 20 could alternatively be molded, pressed, carved, etched, painted, or otherwise formed in any manner. Preferably, depth 30 is relatively constant throughout the extents of block 12, excepting the variations caused by the splitting process and also excepting splitting recesses or other interruptions in the split look of front face 20. Splitting recesses 21 are preferably formed in front face 20 to provide an area for splitting block 10 along a straight line.

Top surface 24 is separated from bottom surface 26 by a distance defining the height 32 of block 12. When blocks 12 are arranged vertically to form a column 14, bottom surface 26 of any block 12 other than the bottom block of a column, rests on the top surface 24 of the block below. It is therefore preferred that top surface 24 and bottom surface 26 are so shaped to facilitate a stacking relationship between two blocks 12 that results in an upper block 12 resting vertically on a vertically oriented lower block 12. This relationship is most easily achieved by making top surface 24 and bottom surface 26 flat and relatively perpendicular to rear face 22 and/or front face 26, as shown in the Figures. Alternatively, it is envisioned that top and bottom surfaces 24 and 26 be comprised of complementary angles which are not perpendicular to rear face 22 and/or front face 26, but result in the vertical relationship between upper and lower blocks 12, described above. It is also envisioned that this relationship be achieved through the use of concave and convex surfaces or using tongue and groove configurations.

Side surfaces 28A and 28B, as shown in FIG. 2, are preferably somewhat perpendicular to rear face 22 and/or front face 20 and preferably comprise a groove 34 for receiving a portion of beam 16, shown in FIG. 3. Alternatively, it is envisioned that one side surface 28A or 28B have a groove and the other side surface have a tongue configured to mate with the groove, thereby obviating the need for beams 16. However, in order to maintain the vertically independent characteristics of columns 14, the use of beams 16 is preferred.

Beams 16, shown in FIG. 3, preferably comprise a spine or web 36 and at least one rib 38. Preferably, there are two pairs of ribs 38A and 38B. This configuration of two pairs of ribs 38A and 38B attached to each other by web 36 forms somewhat of an I-beam configuration. It is preferred that one set of ribs 38A are resiliently deformable and even more preferred that they comprise flanges 40 to assist in guiding them into grooves 34. A biased, resiliently deformed rib 38A exerts an even force on groove 34 as it pushes thereagainst towards rib 38B and prevents unwanted movement and misalignment between blocks 12 of a given column 14.

The distance between rib 38A and 38B is herein defined as the span 42 of the rib. The span 42 should either be as great as the distance between the groove 34 and the rear face 22, or, in the case of the resiliently deformable rib 38, should be able to achieve this distance through deformation when installed into the groove 34 of a block 12.

Beams 16 may or may not be attached at their upper ends to the structure being skirted, at or near its bottom. Attaching beams 16 thusly provides support and stability to the independent columns 14, preventing them from leaning or falling forwardly or rearwardly. Beams 16 also act to align the blocks 12 of a given column 14, ensuring that the blocks maintain a somewhat coplanar relationship.

Figure 6:
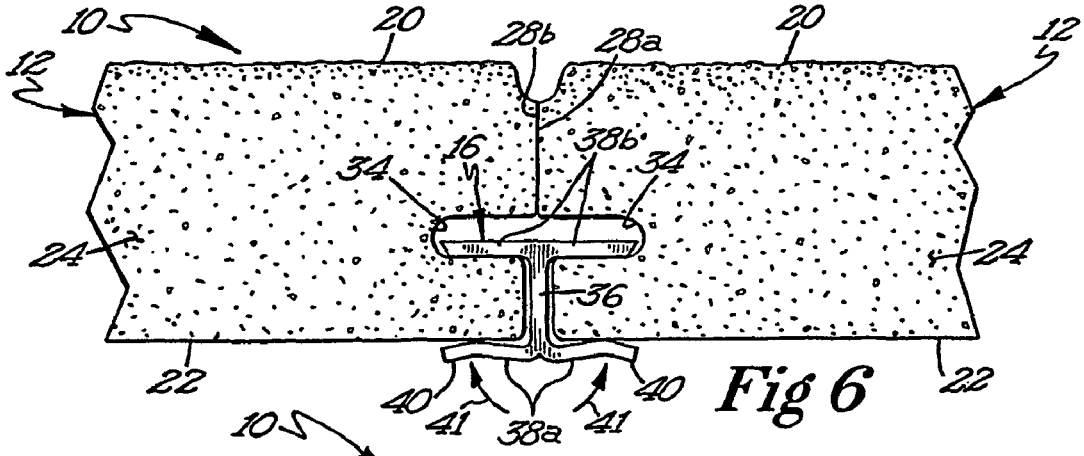
FIG. 6 is a plan view of two blocks abutted with a support beam installed using an alternative configuration.
Figure 7:
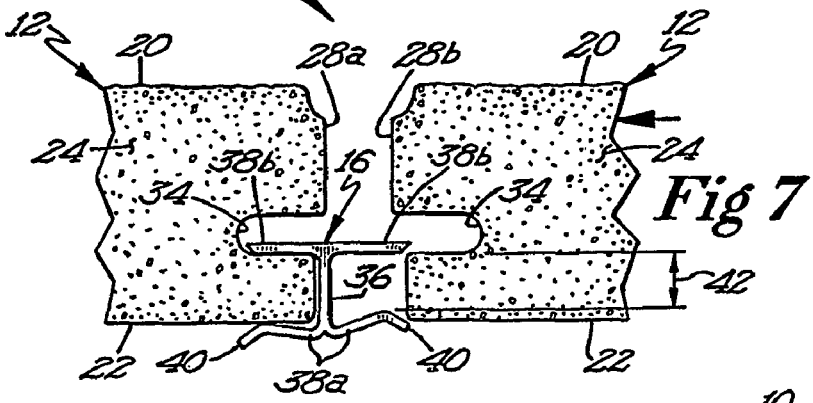
FIG. 7 is a plan view of two blocks being pressed together and resiliently deforming a support beam.

FIGS. 6–9 show a variety of envisioned beam constructions and arrangements. FIG. 6 shows a preferred arrangement of the preferred beam construction shown in FIGS. 3 and 5. It can be seen that preferably, beam 16 is placed in the opposing grooves 34 of adjacent blocks 12 so that resiliently deformable ribs 38A having flanges 40 are rearward of ribs 38B. Doing so utilizes the forces exerted by the bias of ribs 38A to urge the forward edges of opposing sides of adjacent columns of blocks 28A and 28B together to minimize gaps therebetween. Arrows 41 represent these forces. FIG. 7 shows how flanges 40 act to guide block 12 as it moves toward and engages beam 16.

Figure 8:
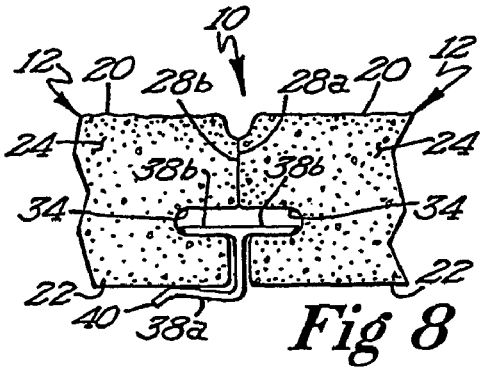
FIG. 8 is a plan view of two blocks abutted with an alternative embodiment of a support beam.
Figure 9:
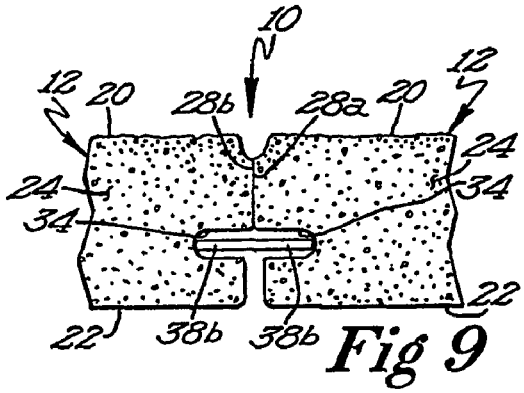
FIG. 9 is a plan view of two blocks abutted with another alternative embodiment of a support beam.

FIG. 8 shows an alternative embodiment of beam 16 having two ribs 38B but only one resiliently deformable rib 38A. FIG. 9 shows yet another embodiment of a beam 16 comprising one pair of opposed ribs 38B such that the support beam 16 is essentially an elongate spline.

It is envisioned that brackets 18 be used in conjunction with beams 16 to provide stability to wall 10. Referring now to FIG. 4, it can be seen that brackets 18 comprise a front wall 44 having a top edge 45 and a bottom edge 47, a rear wall 46 rearwardly spaced apart from front wall 44, and a top wall 48 joining top edge 45 of front wall 44 and rear wall 46. Front wall 44 and rear wall 46 define a downward opening 50 into which the top surface 24 of the top block 12 of a column 14 may be inserted. In operation, bracket 18 is attached to the underside of a structure to be skirted and positioned so that the top block 12 of a column 14 is inserted into opening 50 and so that the bracket is located near the middle of the block 12. It may be desired to make rear wall 46 of a greater vertical dimension that front wall 44 to provide additional support. It may also be desired to provide a bracket 18 with a rear wall 46, which extends in a lateral direction further than front wall 44. Furthermore, it is envisioned that brackets 18 could be a variety of lengths. For instance, brackets 18 could be as short as one inch or as long as the entire wall.

Brackets 18 prevent rearward or forward movement of column 14 and also work in conjunction with beams 16 to prevent those columns 14 without brackets 18 from tipping over rearwardly or forwardly. As it is envisioned that beams 16 may or may not be attached to the structure, brackets 18 may be solely responsible for preventing wall 10 from tipping over. Brackets 18 can be of any suitable material, preferably synthetic, more preferably poly-vinyl chloride (PVC) or other durable plastic. It may be advantageous to make brackets 18 and beams 16 out of similar material.

Figure 10:
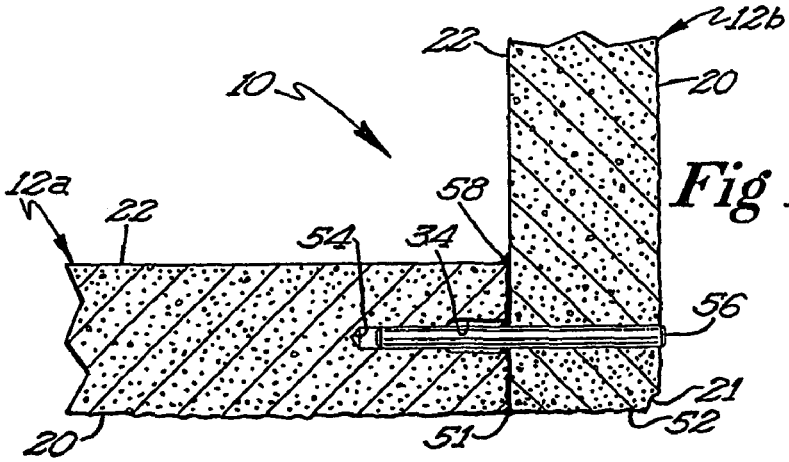
FIG. 10 is a plan view of an embodiment of a corner of the wall structure of the present invention.

FIG. 10 shows a preferred corner configuration using the blocks 12 of the present invention. The design of block 12 lends itself to the formation of corners without the need for mortar, corner braces, or other supports. Two blocks 12A and 12B are simply aligned to form a corner butt joint 51. Preferably block 12B is broken along its splitting recess 21 to form a new split face 52 which roughly matches split front face 20 of block 12A. Holes 54 are drilled through blocks 12A and 12B so that fastener 56 may be inserted. Fastener 56 may be any suitable fastener, preferably a screw or peg. Preferably such as appropriate plastic pegs or screws and plastic inserts are used to fasten one wall to the other. Alternatively, glue, preferably construction mastic 58, may be applied instead of or, more preferably, in combination with fasteners 56.

Figure 11:
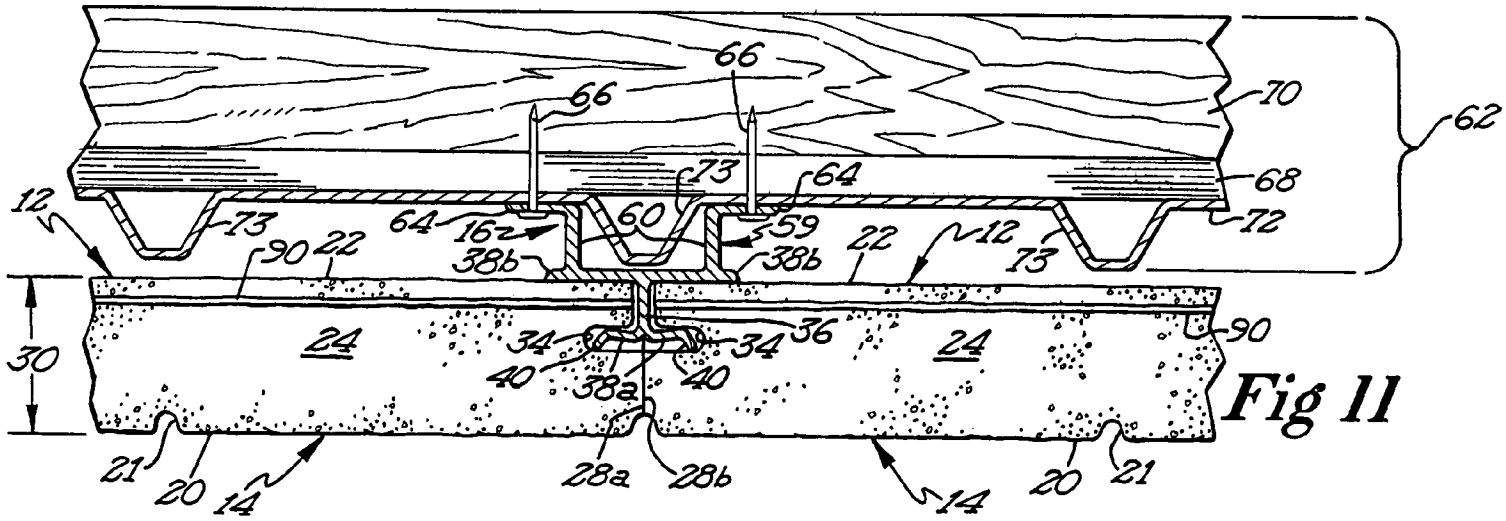
FIG. 11 is a plan view of a two abutting blocks with another alternative embodiment of a support beam coupling the blocks to an existing structure.

FIGS. 11–15 illustrate additional embodiments of the present invention. FIG. 11 illustrates a support beam 16 having a pair of leg structures 59 that are constructed and arranged to secure a wall comprising columns 14 of blocks 12 to an existing support structure 62. The support structure may be a building or any other type of structure that may require a wall structure 10 according to the present invention. Legs or leg portions 60 of the leg structures 59 extend rearwardly from the support beam 16 and are preferably secured to ribs 38B thereof. The leg structures 59 may also be formed as part of the web 36 of the support beam 16. Each leg or leg portion 60 has a foot 64, which extends laterally therefrom to provide a point of connection for the support beam 16 to the existing structure 62. Nails, screws, or other appropriate fasteners 66 are driven through the feet 64 of the support beam 16 and into the sheathing 68 of the wall of the existing structure 62. The sheathing 68 of the typical wall is typically supported by a plurality of horizontal girts 70. Once the support beam 16 has been secured to the existing structure 16, blocks 12 are stacked between respective support beams 16 as illustrated in FIG. 11 such that ribs 38A of the support beam 16 are inserted into the grooves 34 in the sides of the blocks 12. Note that the number, construction, and arrangement of ribs 38A and 38B may vary as described above in conjunction with FIGS. 5–9.

In order to prevent the inflow of water into the wall structure 10, it may be desirable to apply a bead of a waterproof material 90 such as mastic or caulk along the top surface 24 of the blocks 12. The bead of waterproof material 90 forms a seal between the upper surface 24 of the lower block 12 upon which the bead has been placed and the lower surface 26 of the block 12 immediately above the lower block.

Legs or leg portions 60 of support beam 16 preferably extend rearwardly from ribs 38B in a perpendicular relationship thereto. Similarly, it is preferred that the feet 64 of the support beam 16 extend laterally perpendicular to the legs 60. The perpendicular relationship of the feet and legs to the remainder of the support beam 16 is the preferred embodiment thereof, it must be kept in mind that the purpose of the legs 60 and feet 64 is to provide and offset for the block wall 10 from the wall of the existing structure 62. This offset allows a block wall 10 to be secured over uneven surfaces such as the steel siding 72 illustrated in FIG. 11. As can be seen, legs or leg portions 60 of support beam 16 are sufficiently long such that the support beam 16 clears ridge 73 of the steel siding 72. As can be appreciated, steel siding 72 typically presents a plurality of vertically flat attachment surfaces. Where a wall structure 10 is to be applied to a wall of an existing structure 62 that is not vertically smooth, furring strips or blocking may be fastened to the wall of the existing structure 62 as needed. As support beams 16 provide no vertical support for the blocks 12, the blocks must be provided with some sort of foundation. Examples of suitable foundation include a concrete pad or footing that is sunk into the ground, and a cantilever ledge or bracket which is securely affixed to the wall of the existing structure.

Figure 12:
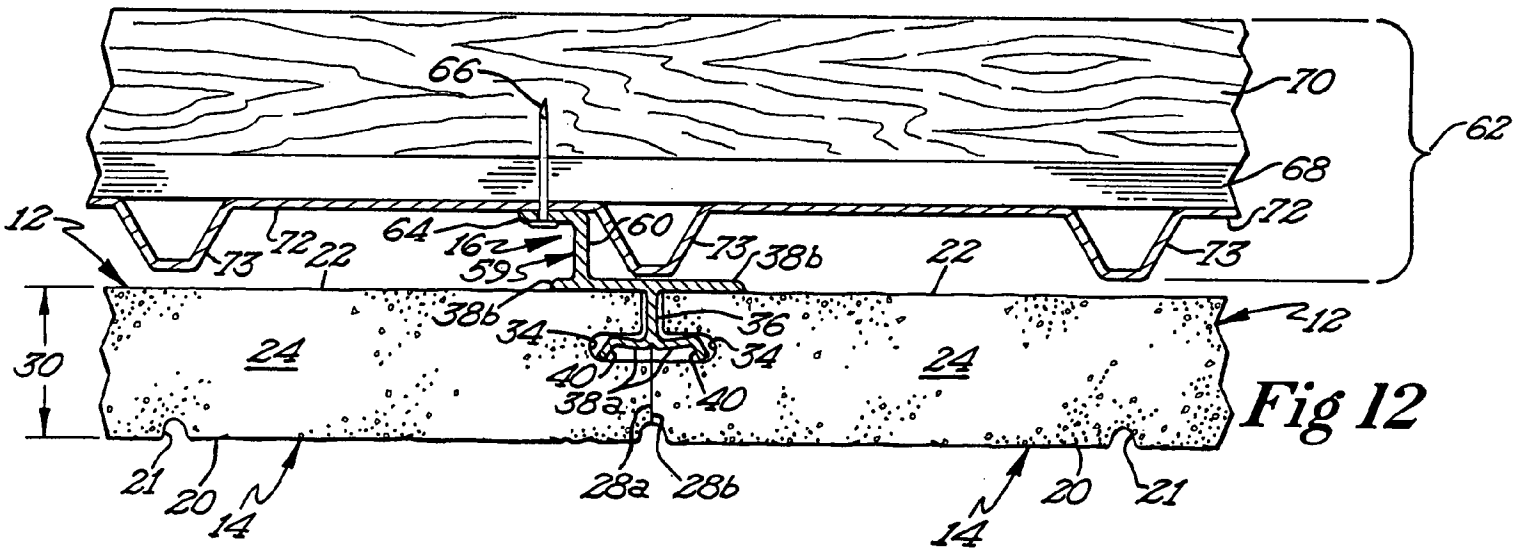
FIG. 12 is a plan view of a two abutting blocks with another alternative embodiment of a support beam coupling the blocks to an existing structure.

FIG. 12 illustrates a support beam 16 having two pairs of ribs 38A and 38B separated by a web 36 and only a single leg structure 59 comprising a leg 60 portion and foot 64. The embodiment of FIG. 12 is particularly useful when an obstruction such as ridge 73 of steel siding 72 would prevent one of the leg structures 59 illustrated in FIG. 11 from securely contacting the wall of the structure 62. Fasteners 66 are sufficient to provide the requisite lateral support for the wall structure 10. The support beam 16 having only a single leg structure 59 may be rotated end-for-end depending on the offset location of an obstruction such as ridge 73.

Preferably the support beam 16 of the present invention will be extruded or molded from a material such as a plastic, a fiber reinforced resin, or a metal such as aluminum. In addition to forming embodiments of support beams 16 having the respective profiles of the support beams illustrated in FIG. 12, it is possible that one leg structure 59 could be removed from a support beam 16 such as the support beam 16 of FIG. 11 having two leg structures 59, thereby resulting in the support beam embodiment illustrated in FIG. 12. However, where a single leg structure 59 would be sufficient to provide the needed lateral support for a wall structure 10, it would be more economical to manufacture support 16 having only a single leg structure 59.

Figure 13:
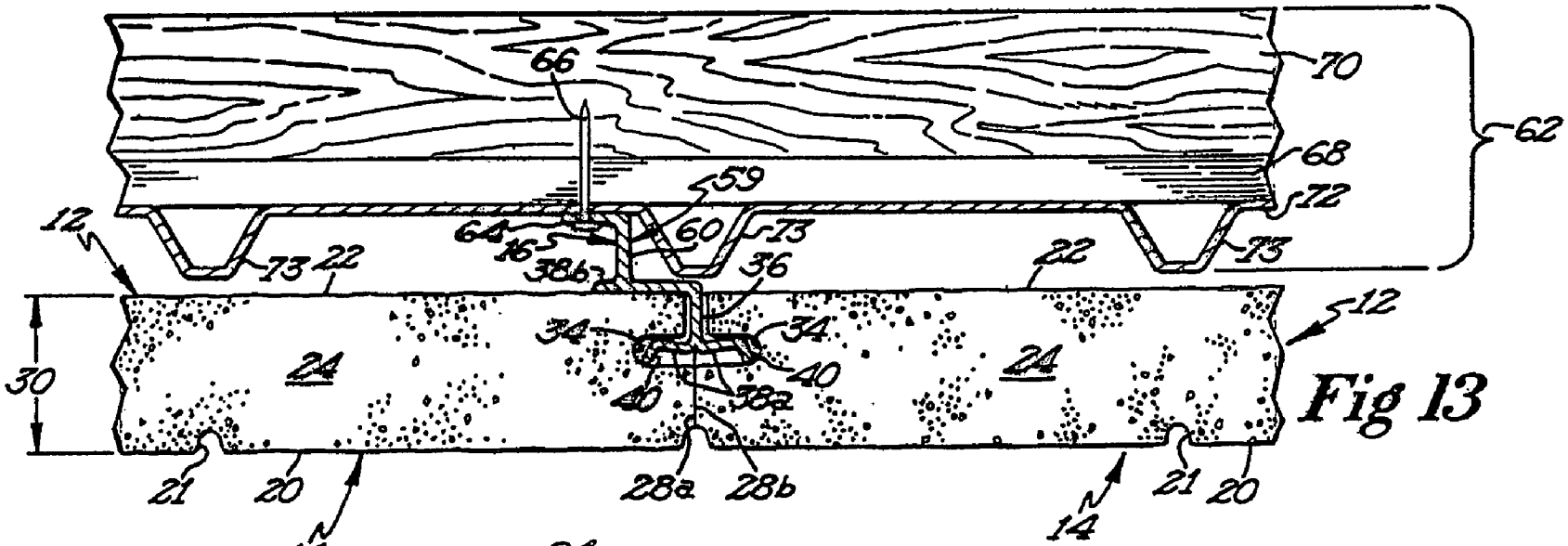
FIG. 13 is a plan view of a two abutting blocks with another alternative embodiment of a support beam coupling the blocks to an existing structure.

FIG. 13 illustrates a support beam 16 that is constructed and arranged to provide lateral support to a wall structure 10 as described in conjunction with FIGS. 11 and 12. The main difference here being that the support beam 16 of FIG. 13 has a pair of flanges 38A and only a single flange 38B extending from the web 36. Leg structure 59 extends rearwardly from the flange 38B preferably in a perpendicular relation thereto. While it is preferred that the leg or leg portion 60 and foot 64 be arranged at right angles to each other and to the ribs 38B of the support beam 16, these structures may be arranged at any angle to one another provided, of course, that there is a sufficient offset from the wall of the existing structure 62 to allow installation of the blocks 12 of the wall structure 10 and that the foot 64 of leg structure 59 may be securely fastened to a supporting structure 62.

Figure 14:
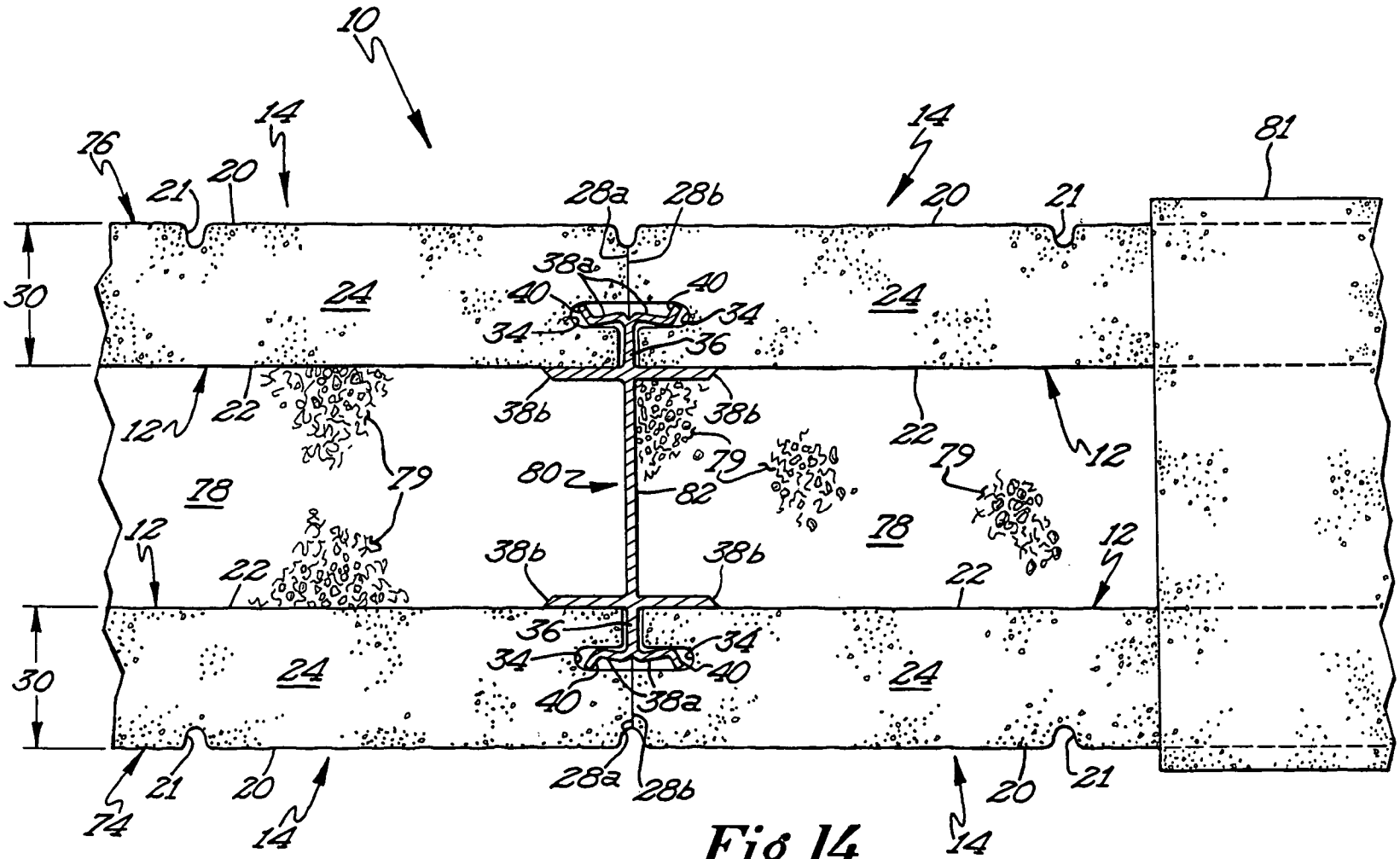
FIG. 14 is a plan view of a double-sided free standing wall structure wherein the respective sides of the wall structure are coupled together by a double ended support beam; and, FIG. 15 is a plan view of a freestanding wall structure in which the support beam is formed integral to a post.

FIG. 14 illustrates a double-ended support beam 80, which is useful for constructing a dual wall structure 10 having a front face 74 and a rear face 76. The space 78 between the front and rear faces 74, 76 of the dual wall structure 10 of FIG. 14 may remain hollow or may be filled. As can be seen from FIG. 14 each end of the double ended support beam 80 comprises a support beam or block engagement structure having a cross-sectional profile similar to the support beam 16 illustrated in FIG. 5. As depicted, the support beams or block engagement structures are arranged back-to-back in a spaced apart relation and connected by a spacer web 82. Spacer web 82 is connected to the base pair of ribs 38B of each of the support beam portions in a perpendicular fashion. In this manner, support beam 80 couples dual walls of the wall structure 10 provide mutual lateral support. Further support can be had by backfilling the space 78 between the front and rear sides of the dual wall structure 10 with gravel, earth, sand, concrete, or an insulating material 79. It will be appreciated that, a cap 81 may be placed over the top of the dual wall structure 10 of FIG. 14 to prevent the ingress of water and nuisance animals. It will also be appreciated that such a cap 81 may be secured to the dual wall structure by known technologies and techniques, if desired. See, for example, the use of adhesive material depicted FIG. 11.

Figure 15:
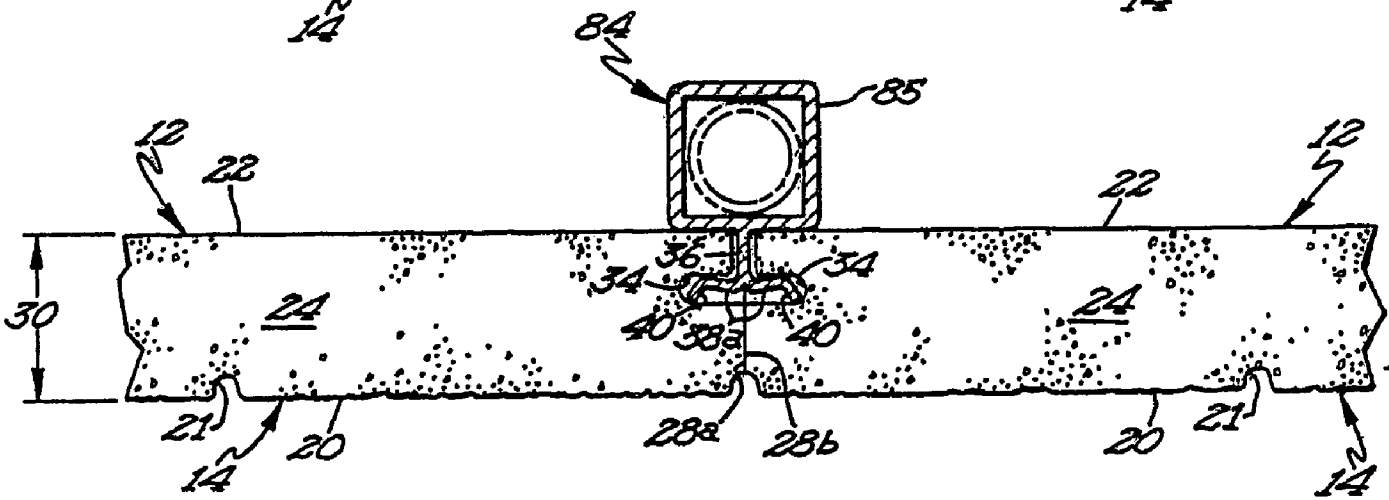

FIG. 15 illustrates a single sided wall structure 10 comprising columns 14 of blocks 12 supported by a post-like support beam 84. Support beam 84 comprises a post 85 having extending therefrom a web 36. A pair of ribs 38A extend laterally from the web 36 in the same manner as the ribs of support beams 16 described in conjunction with FIG. 3. As installed, post 85 is preferably rigidly seated in a footing or foundation set into the ground below the wall structure 10. As can be appreciated, blocks 12 are stacked between respective post support beams 84 as described above. The posts 85 of the post-support beam 84 preferably have a hollow cross section. However, post 85 may also be a solid in cross section or may have a reinforcing structure such as a pipe or a rod received therein. An alternate embodiment for the post to support beam 84 involves securely seating a plurality of rods or members in footings or a foundation beneath the wall structure 10 and sliding the post beam 84 of the type illustrated in FIG. 15 thereover. Blocks 12 would then be disposed between respective pairs of post support beams 84 as described above.

Figures 16, 17A, 17B:
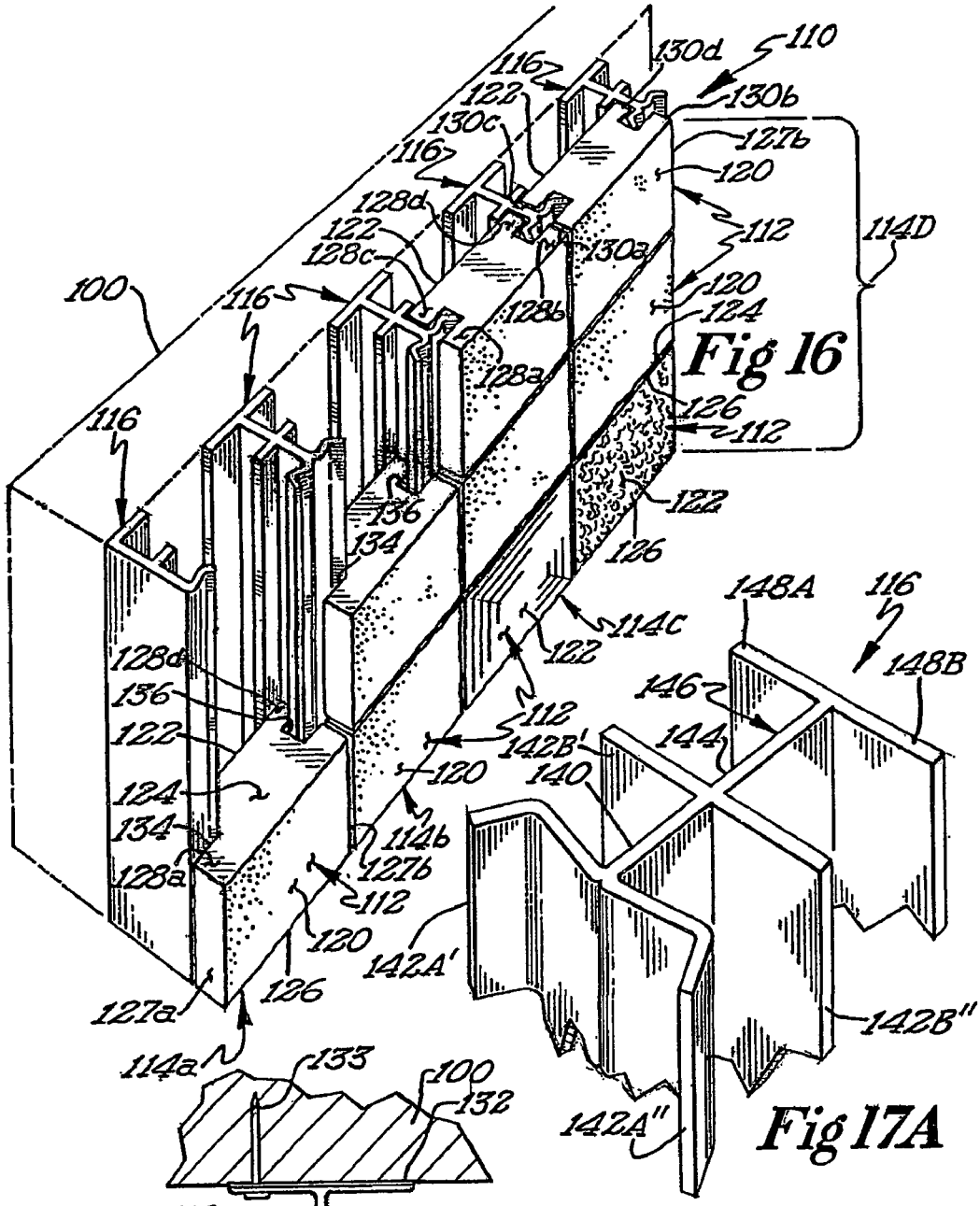
FIG. 16 is a perspective view of another preferred embodiment of support beams and blocks used to construct a wall structure of the present invention.
FIG. 17A is partial, perspective view of a support beam of the preferred embodiment of the wall structure of FIG. 16.
FIG. 17B is a partial, top plan view of the support beam of FIG. 17A as it may be used to operatively connect blocks to a substructure.

With reference to FIG. 16, a partially assembled wall structure 110 comprising a plurality of blocks 112 retained in place by a plurality of vertically oriented, elongated support beams 116 that are operatively connected to a substructure 100 (shown in dashed lines) is depicted. As can be seen, the support beams 116 allow blocks 112 of adjacent horizontal courses to be substantially superposed one above the other and not laterally offset from each other in a bond pattern as one may expect of such a wall structure. Thus, the wall structure 110 is comprised of a plurality of adjacent columns 114A–D that may be operatively connected to each other in a serial fashion. Each block 112 of the wall structure 110 includes a front face 120, a rear face 122, a top surface 124, a bottom surface 126 and opposing sides 127A,B. Each opposing side 127A,B includes opposing grooves 134, 136 respectively, defined by pluralities of outwardly extending fingers 128A,C and 128B,D, with outwardly facing surfaces 130A,C and 130B,D.

Preferably, the blocks 112 are symmetrically formed, so that either the front or rear face 120,122, respectively, may face forwardly. This feature allows a block which has been damaged or had its surface otherwise altered to be easily removed and reinstalled by merely turning the block around (or over) so that other good or undamaged side now being the viewable surface of the block. In other words, the blocks are reversible. The front and rear faces need not have the same surface treatment. That is, a block may have a smooth front face and a roughened rear face. Or, a block may have roughened front face and a decorated or non-planar rear face. For example, in FIG. 16, the lower most blocks of column 114C and column 114D, respectively, have forwardly facing rear faces 122 while the remaining blocks in the partially assembled wall structure 110 have forwardly facing front faces. As depicted, the viewable front faces 120 of the blocks 112 of the wall structure 110 are smooth and the viewable rear faces 122 of the blocks of the wall structure 110 are roughened or otherwise decorated.

With reference to FIGS. 17A and 17B, the support beam 116 is similar to the support beam of prior embodiments (See, for example, FIG. 3) in that it includes a web 140 from which a plurality of ribs 142A', 142A", 142B' and 142B" extend. In a departure from previous embodiments, the support beam 116 of this embodiment includes an extension 144 that terminates with an attachment member 146. Preferably, the extension 144 is aligned with, and extends from the web 140 so as to position the attachment member 146 a predetermined distance from the plurality of ribs. This serves several purposes. As explained above, not only does this creates spaces between a wall structure and a substructure that may be used as plenums, conduits, or for retaining insulative, fire-retardant or other building materials, but it also facilitates attachment of the support beam 116 to a substructure 100 (shown in dashed lines). Preferably, the attachment member 146 comprises feet 148A and 148B that extend laterally in opposite directions from the extension 144 to provide a point or points of connection which may be used with adhesive 132 or fastening elements such as nails or screws 133 in attaching a support beam to a substructure.

Figure 18B:
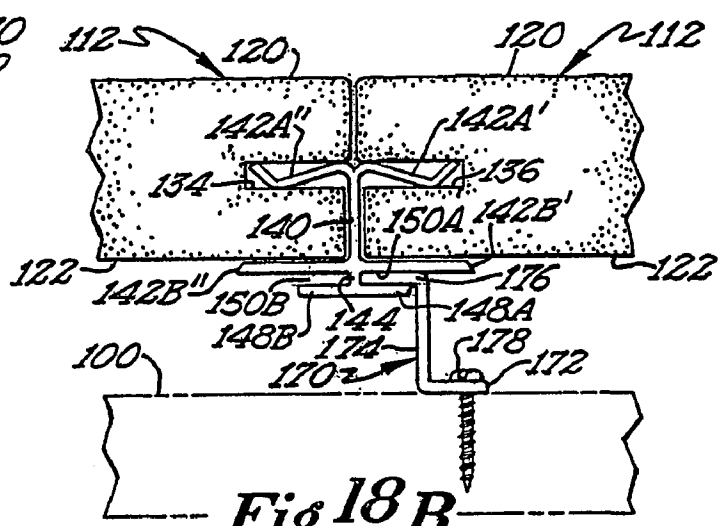
FIG. 18B is a partial, top plan view of the support beam and bracket of FIG. 18A as they may be used to operatively connect blocks to a substructure.
Figure 18A:
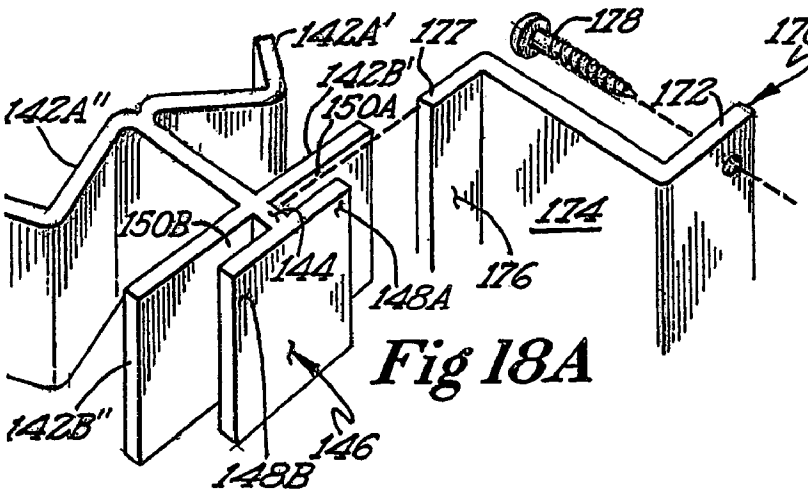
FIG. 18A is partial, perspective view of another embodiment of a support beam and bracket that may be used in conjunction with blocks of FIG. 16 to construct a wall structure.

Referring now to FIGS. 18A and 18B, the support beam 116, again, has an extension 144 which terminates in an attachment member 146 with feet 148A, 148B. However, in this embodiment the extension 144 and the feet 148A, 148B are foreshortened. Note that the support beam 116 is not directly connected to a substructure but is operatively connected to a bracket 170 that is, in turn, operatively connected to a substructure 100 (shown in dashed lines). The bracket 170 includes a substructure engaging portion 172, a span 174 and an attachment member 176 with a support beam engaging portion 177. The support beam engagement portion 177 is sized to be snuggly received and frictionally retained within a channel (150A or 150B) formed by a rib and a foot (142B', 148A; 142B", 148B, respectively) of the beam 116. Note that the support beam 116 need not extend along the length of the bracket 170, and more particularly the support beam need not be coextensive with the side of a block to which it is operatively connected. The reason for this is that a block need not be retained along its entire length of its grooves to be adequately retained as part of a wall structure. Instead, it is only necessary for a block to retained at several points. Thus, the support beams 116 may take the form of clips that attach to the bracket 170, and a block may be retained at a plurality of predetermined locations such as its upper and lower ends. It will be appreciated that such support beam clips may be used to operatively connect a pair of blocks to a support bracket by positioning the clips so that they span the interface between two adjacent blocks. It will also be appreciated that the support beam clip may be longer than a side of a block to which it is operatively connected so that it may operatively connect more than two blocks to a bracket.

The span 174 of the bracket 170 serves to position the support beam 116 a predetermined distance from a substructure while the substructure engaging portion 172 serves to attach the bracket 170 onto a substructure. As with the aforementioned embodiment the bracket 170 may be operatively connected to a substructure using a variety of fastening elements. It will be appreciated that the support beam 116 of this embodiment may be used with an additional bracket 170, if desired, to form a more robust connection between the wall structure and a substructure.

Figure 19B:
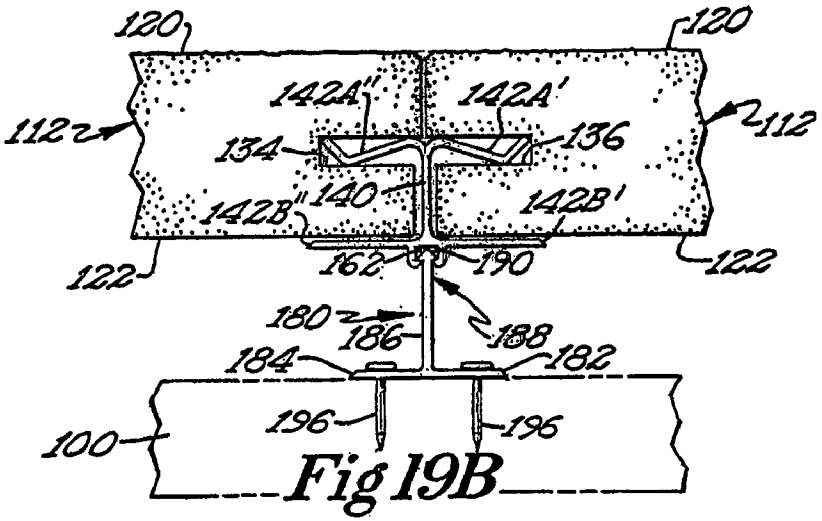
FIG. 19B is a partial, top plan view of the support beam and bracket of FIG. 19A as they may be used to operatively connect blocks to a substructure.
Figure 19A:
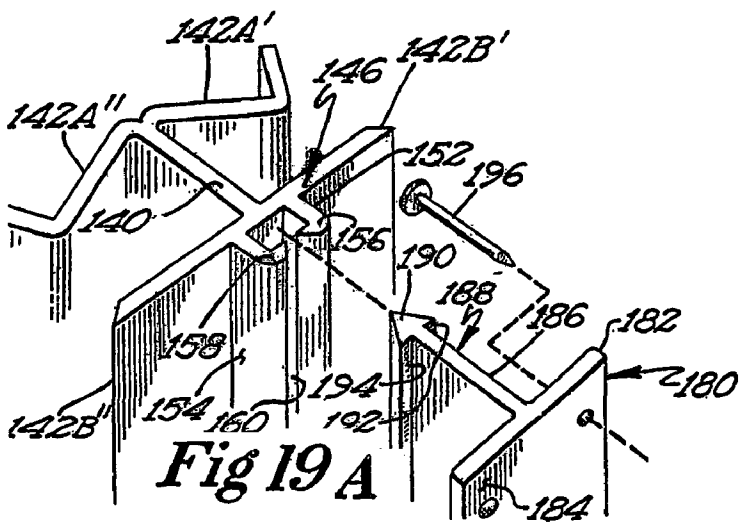
FIG. 19A is a partial, perspective view of another embodiment of a support beam and bracket that may be used in conjunction with blocks of FIG. 16 to construct a wall structure.

Referring now to FIGS. 19A and 19B, the support beam 116 does not have an extension (depicted as 144 in FIGS. 17 and 18). Rather, the beam 116 terminates at an attachment member 146 that includes two spaced apart resilient walls 152, 154 having confronting arms 156, 158 which define a slot 160 and channel 162 which are sized to admit and retain a second attachment member.

With this embodiment, the support beam 116 is not directly connected to a substructure but is operatively connected to a bracket 180 that is, in turn, operatively connected to a substructure 100 (shown in dashed lines). This bracket 180 includes substructure engaging portions 182, 184, a span 186 and an attachment member 188. Preferably, the attachment member 188 is a dart-shaped head 190 having shoulders 192, 194 which are configured to engage arms 156, 158 in a constrained relation. That is, the attachment member 146 of the support beam is sized to slidingly receive the attachment member 188 within a slot 160 and channel 162 formed by the resilient walls 152, 154 and their confronting arms 156, 158. Thus, support beam 116 may be connected to bracket 180 in a constrained manner. It will be appreciated that support beam 116 may be operatively connected to a bracket 180 in several ways. For example, by positioning the channel 162 and the slot 160 attachment member 146 over the dart-shaped head 190 and the span 186 of the attachment member 188 of bracket 180 and then sliding the support beam 116 down along the bracket 180 and interconnecting with an already positioned block, or sliding down along the bracket and later interconnecting with a block which is slid into position in a similar manner. Alternatively, a support beam 116 may be operatively connected to a bracket 180 by aligning the slot 160 of the attachment member 146 opposite the apex of the dart-shaped head 190 and then pushing the support beam 116 towards the dart-shaped head 190 until the arms 156, 158 of the attachment member 146 engage the shoulders 192, 194 of the dart-shaped head 190.

Support beam 116, like the support beam of FIG. 18, need not extend along the length of the bracket 170, and more particularly the support beam need not be co-extensive with the side of a block to which it is operatively connected. The reasons for this have been discussed in conjunction with the description of FIGS. 18A and 18B, and for purposes of brevity will not be repeated. The span 186 of bracket 180 serves to position the support beam 116 a predetermined distance from a substructure and the substructure engaging portion 182, 184 serves to attach the bracket 180 onto a substructure. As with the aforementioned embodiment the bracket 170 of FIG. 18, bracket 180 may be operatively connected to a substructure using a variety of fastening elements 196.

Figures 20A, 20B, 21A, 21B:
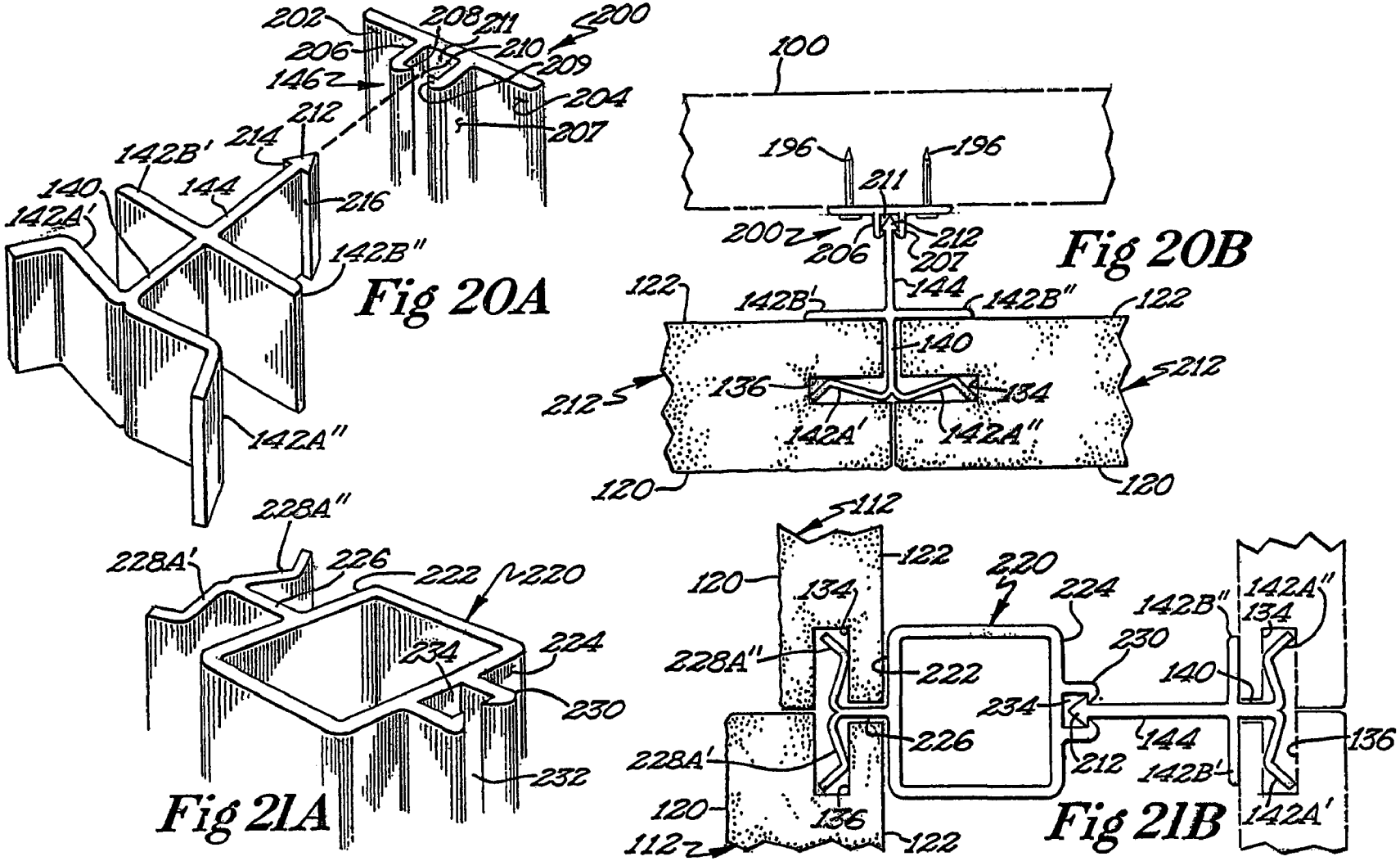
FIG. 20A is a partial, perspective view of another embodiment of a support beam and bracket that may be used in conjunction with blocks of FIG. 16 to construct a wall structure.
FIG. 20B is a partial, top plan view of the support beam and bracket of FIG. 20A as they may be used to operatively connect blocks to a substructure
FIG. 21A is a partial, perspective view of an embodiment of a post having an integrally formed support beam and an integrally formed bracket, with the post used to construct a double-sided wall structure.
FIG. 21B is a top plan view of the post of FIG. 21A with the addition of partially depicted, differently sized wall blocks operatively connected thereto.

Referring now to FIGS. 20A and 20B, the operative connection is reversed from FIGS. 19A and 19B. That is, support beam 116 includes an extension 146 that terminates in an attachment member 146 having a dart-shaped head 212 with shoulders 214, 216. The bracket 200 now includes two spaced apart resilient walls 206, 207 having confronting arms 208, 209 which define a slot 210 and channel 211 which are sized to admit and retain attachment member 212 in a constrained relation, as discussed above. As with the aforementioned embodiments, the support beam 116 need not extend along the length of the bracket 200. And, the bracket 180 may be operatively connected to a substructure using a variety of fastening elements.

Referring now to FIGS. 21A and 21B, another preferred embodiment depicts a post 220 which has been provided with a plurality of connectors to enable the post to support a plurality of wall structures. In this embodiment, the post 220 includes opposing sides 222, 224 from which extend a web 226 and a bracket 230, respectively. A pair of ribs 228A', 228A" extend laterally in opposite directions from the web 226 in the same manner as the ribs of support beams 116 described in conjunction with FIG. 3, while the bracket 230 includes the slot 232 and channel structure 234 similar to the slot and channel structures described and shown in FIGS. 19A,B and 20A,B. Thus, with this embodiment, blocks may be directly connected to the post 220 at side 222 or connected indirectly at side 224 via an appropriately configured support beam.

Other combinations of operative connections may also be used. For example, the post 220 may be provided with two direct connectors (webs with laterally extending ribs) or the post 220 may be provided with two indirect connectors (attachment members, such as channels). As will be appreciated, the post 220 may be operatively connected to a substructure such as a footing or foundation, or be set into the ground using known techniques and technologies. While the post 220 is depicted as having a hollow cross section, it is understood that the post 220 may also be a solid in cross section or may have a reinforcing structure such as a pipe or a rod received therein.

Figure 22A:
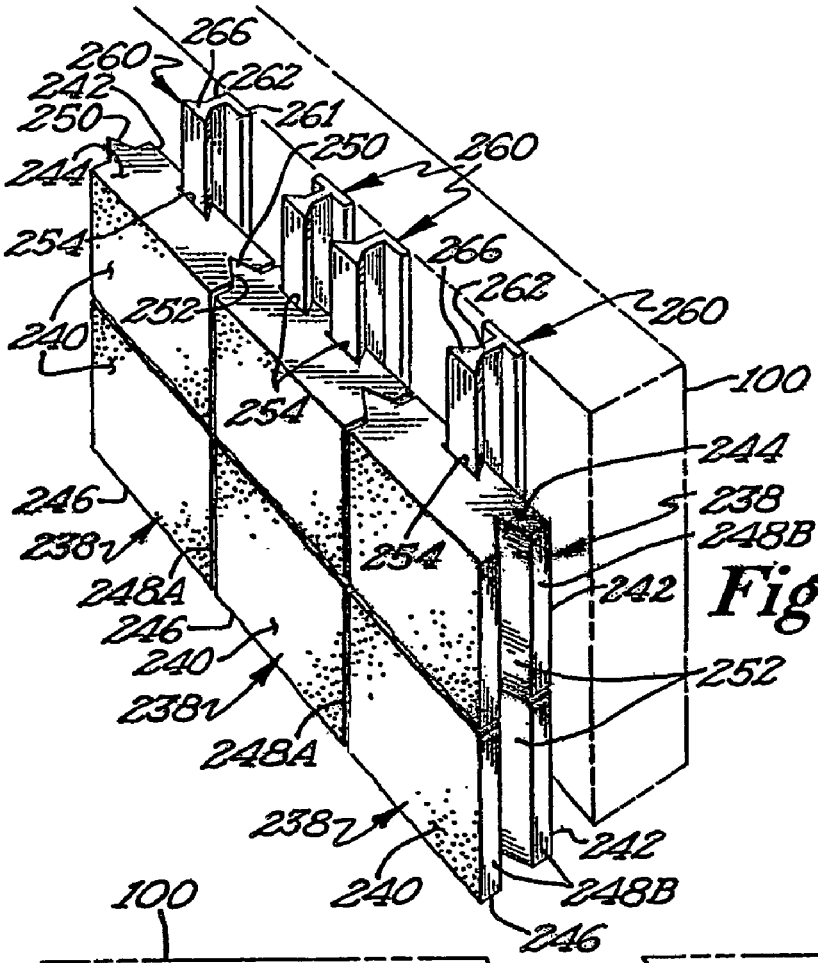
FIG. 22A is a perspective view of another preferred embodiment of support beams and blocks used to construct a wall structure of the present invention.

Referring now to FIG. 22A, a partially assembled wall structure comprising a plurality of blocks 238 retained in place by a plurality of vertically oriented, elongated support beams 260 that are operatively connected to a substructure 100 (shown in dashed lines) is depicted. As can be seen, the support beams 260 allow blocks 238 of adjacent horizontal courses to be substantially superposed one above the other and not laterally offset from each other in a bond pattern as one may expect of such a wall structure. Thus, the wall structure is comprised of a plurality of adjacent columns that are operatively connected to each other in a serial fashion as in FIG. 16A. Each block 138 of the wall structure includes a front face 240, a rear face 242, a top surface 244, a bottom surface 246 and opposing sides 248A,B. In a departure from previous embodiments, each opposing side 248A,B includes a projection 250 and a recess 252, respectively. As will be appreciated the projection and the recess of each block may be complimentarily shaped to facilitate alignment of adjacent blocks in a course of blocks, and to add strength to a wall structure. Note that the operative connection between the blocks and a support beam is made at the rear of the block 238 through one or more transversely oriented grooves 254. The grooves 254 are configured to engage an attachment member of a support beam or bracket that is operatively connected thereto. Preferably, each groove and attachment member are complimentarily shaped in a dovetail fashion, however, other complimentary shapes may be used.

Figure 22B:
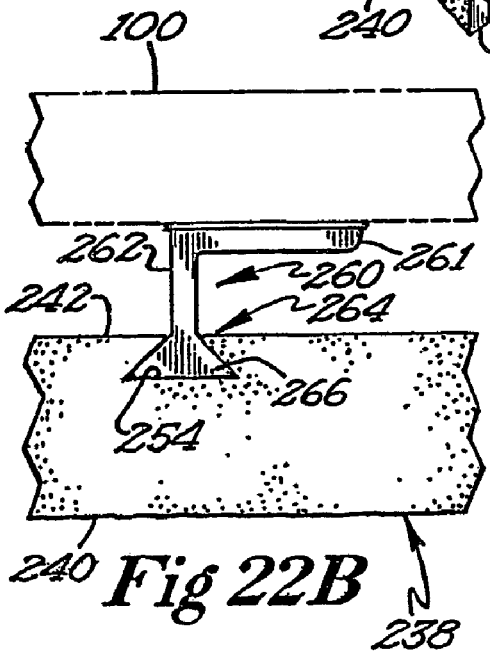
FIG. 22B is a partial, perspective view of an embodiment of a support beam that may be used to operatively connect a block of the wall structure of FIG. 22A to a substructure.

Referring now to FIG. 22B, a block 238 may be operatively connected to a support beam 260 that is in turn operatively connected to a substructure 100 (shown in dashed lines). Here, the support beam 260 includes substructure engaging portion 261, an extension 262 and an attachment member 264 that is configured as a dove-tailed rib 266. The rib 266 is slidingly received within a groove 254 so that when operatively connected to a support beam, a block may be moved along the longitudinal axis of the support beam 260 in a constrained manner.

Figure 22C:
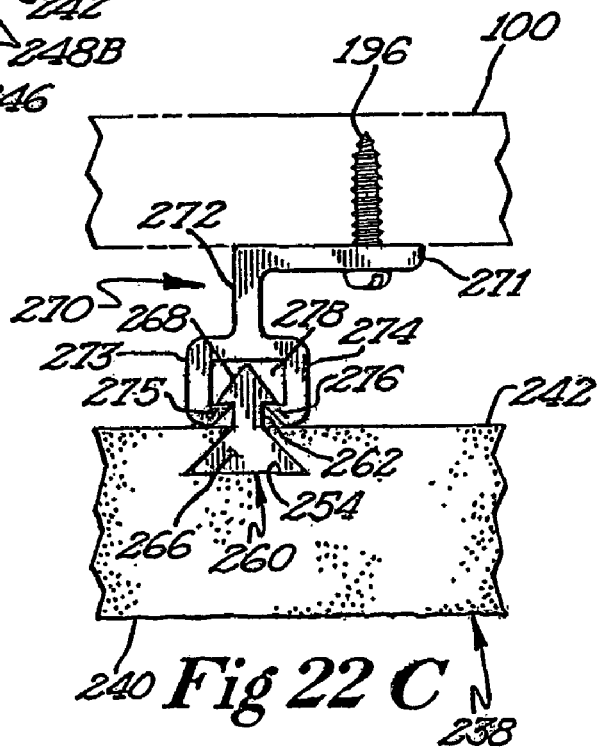
FIG. 22C is a partial, perspective view of an alternative embodiment of a support beam and a bracket that may be used to operatively connect a block of the wall structure of FIG. 22A to a substructure.

Referring now to FIG. 22C, a block 238 may be operatively connected to a support beam 260 which is then operatively connected to a bracket 270, which, in turn, is operatively connected to a substructure 100 (shown in dashed lines). Here, the extension 262 of the support beam 260 is somewhat foreshortened and terminates in a dart-shaped head 268 that extends away from the beam and is configured to operatively connect to a bracket 270. The bracket 270 includes two spaced apart resilient walls 273, 274 having confronting arms 275, 276 which define a slot 277 and channel 278 which are sized to admit and retain the dart-shaped head 268 in a constrained relation—similar to that depicted in FIG. 20B.

Referring now, to FIG. 23A, a partially assembled wall structure comprising a plurality of blocks 279 retained in place by a plurality of vertically oriented, elongated support beams 260 that are operatively connected to a substructure 100 (shown in dashed lines) is depicted. As can be seen, the blocks of one course may be laterally offset from the blocks of an adjacent course in a running bond. Each block 279 of the wall structure includes a front face 280, a rear face 282, a top surface 284, a bottom surface 286 and opposing sides 288A,B that include a projection 290 and a recess 292, respectively. As will be appreciated the projection and the recess of each block may be complimentarily shaped to facilitate alignment of adjacent blocks in a course of blocks, and to add strength to a wall structure.

Unlike the previous embodiment, the operative connection between the blocks 279 and a support beam 260 is indirect. That is, the extension 262 of the support beam 260 terminates in a dart-shaped head 268 that extends away from the beam and is configured to operatively connect to a web 298, which, in turn is operatively connected to blocks 279 of a wall structure 304. As depicted in FIG. 23B, each block 279 includes one or more transversely oriented apertures 294 that are configured to receive a segment of a peg 296 that operatively connects adjacent courses of blocks together. Each peg 296 is also operatively connects the blocks 279 to a support beam 260 by a web 298. As best seen in FIG. 23C, each web 298 is provided with an aperture 300 through which the peg 296 inserted, and an attachment member 302 that includes two spaced apart resilient walls having confronting arms that define a slot and channel that are sized to admit and retain the dart-shaped head 268 of the support beam 260 in a constrained relation—similar to that depicted in FIGS. 20B and 22C. It will be appreciated that a web 298 may operatively connected to a support beam 260 in several ways. For example, by positioning the attachment member 302 over the dart-shaped head 268 of the support beam 260 and then sliding the web 298 down along the support beam until the web 298 encounters a block 279, which may or may not have a peg already installed. Alternatively, a web 298 may be operatively connected to a support beam 260 by aligning the slot of the attachment member 302 opposite the apex of the dart-shaped head 268 and then pushing the web 298 towards the dart-shaped head 268 until the arms of the attachment member 302 engage the shoulders of the dart-shaped head 268. Note that although the support wall 304 depicted in FIG. 23A and FIG. 23D is constructed in a running bond pattern, other configurations are possible.

Figure 24A:
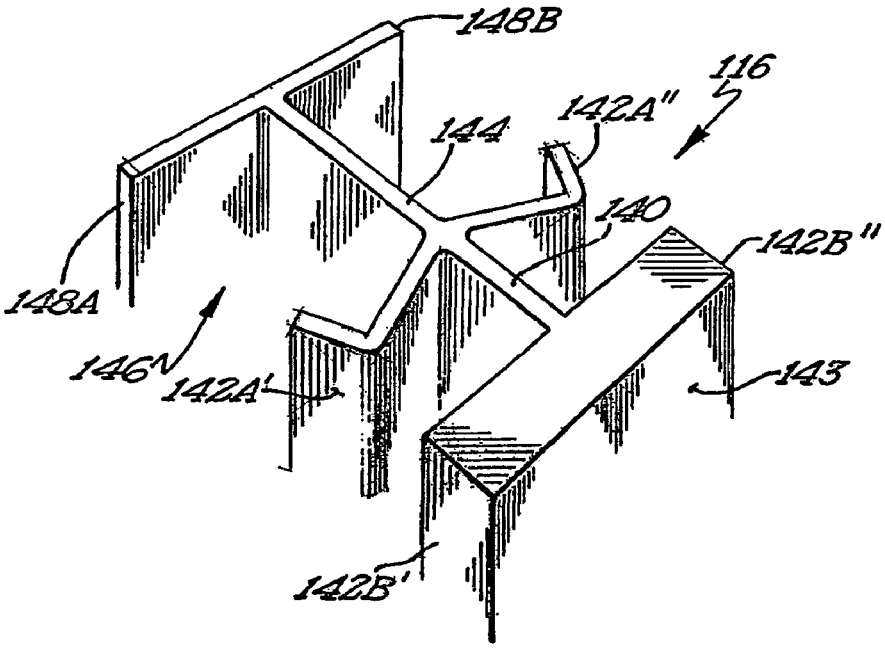
FIG. 24A is a partial, perspective view of a preferred embodiment of a support beam used to construct a wall structure similar to the wall structure of FIG. 16.
Figure 24B:
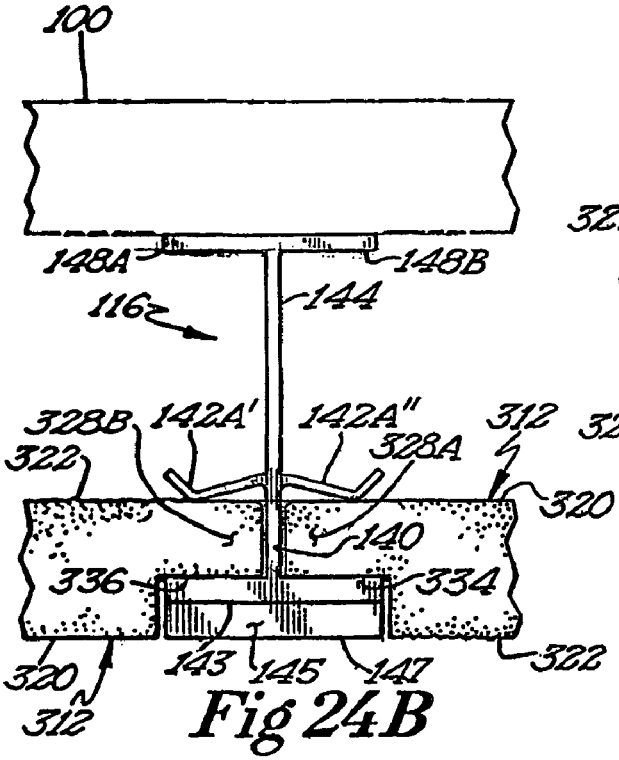
FIG. 24B is a partial, top plan view of an alternative embodiment of the support beam of FIG. 24A as it may be used to operatively connect blocks to a substructure.
Figure 24C:
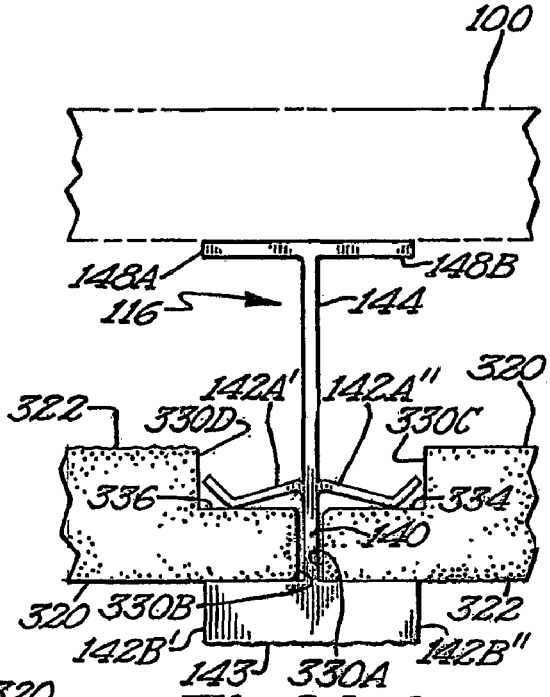
FIG. 24C is a partial, top plan view of the support beam of FIG. 24A as it may be used to operatively connect blocks to a substructure.

With reference to FIGS. 24A, 24B and 24C, the support beam 116 is similar to the support beam of prior embodiments (See, for example, FIG. 7) in that it includes a web 140 from which a plurality of ribs 142A', 142A", 142B' and 142B" extend. In a departure from this previous embodiment, the support beam 116 includes an extension 144 that terminates with an attachment member 146. Preferably, the extension 144 is aligned with, and extends from the web 140 so as to position the attachment member 146 a predetermined distance from the plurality of ribs. In FIG. 24A, the attachment member 146 is depicted as feet 148A and 148B, however it is understood that the attachment member may take other forms such as those depicted in FIGS. 18–20. Turning back to FIG. 24A, note that the ribs 142A', 142A", 142B' and 142B" are reversed relative to each other so that the pair of opposing ribs 142B' and 142B" are now forward relative to the opposing pair of ribs 142A and 142A" (similar to the rib arrangement as depicted in FIG. 7). Note also, that the pair of forwardly facing opposing ribs 142B' and 142B" are somewhat thicker than the pair of opposing ribs 142A' and 142A". This feature allows the support beam 116 to have a viewable surface 143 which may form part of an observed wall structure. As depicted in FIGS. 24B and 24C, ribs 142B', 142B" may be coplanar or collateral relative to the viewable faces of blocks in a wall structure.

Referring now to FIGS. 24B and 24C, the blocks 312 that are used with the aforementioned beam 116 are similar to the blocks 112 depicted in the wall construction 110 of FIG. 16. That is, each block 312 has a front face 320, a rear face 322, a top surface 324, a bottom surface 326 and opposing sides 327. For purpose of simplification, not all these surfaces are identified. One need only refer to FIG. 16 to identify numerically similar numbers.

Each block 312 differs from the block 112 depicted in FIG. 16 in several respects. First, block 312 has only one pair of opposing fingers 328A, 328B instead of the pair of opposing fingers depicted in FIG. 16. Thus, each block 312 does not have a groove that obscures a support beam rib. Instead of a groove, each block 312 has opposing ledges 334, 336 defined by pairs of side surfaces 330A, 330C, 330B, 330D and fingers 328A, 328B, respectively. Preferably, the thickness of the ledges 334, 336 will be substantially the same as the thickness of opposing ribs 142B', 142B", to enable the viewable surface of a wall structure to be substantially contiguous. However, it is understood that the thicknesses of the ledges and/or opposing ribs 142B', 142B" need not be substantially the same. For example, the thickness of the ribs 142B', 142B" may be greater than the thickness of the ledges 334, 336 of the blocks so that the viewable surface 143 of a support beam projects outwardly with respect to the viewable surface of the blocks of the wall structure, or the thickness of the ribs 142B' 142B" may be less than the thickness of the ledges 334, 336 of the blocks so that the viewable surface 143 of the support beam is recessed with respect to the viewable surface of the blocks of the wall structure.

Another difference between block 312 and block 112 is that the opposing laterally extending, aligned fingers 328A, 328B are offset from the center plane of the block 312. As can be seen in FIGS. 24B and 24C, this allows blocks to be operatively connected to a support beam in several configurations. In FIG. 24B, for example, blocks 312 are operatively connected to a support beam 116 so that front face 320 (left side) and rear face 322 (right side) are substantially flush with the viewable surface 143 of the support beam 116. As with the aforementioned blocks of FIG. 16, the front and rear faces may have the same surface or may have different surfaces. Here, the front face 320 on the left side of FIG. 24B is depicted as being smooth, while the rear face 322 on the left side of FIG. 24B is depicted as being roughened. The viewable surfaces on the right side of FIG. 24B are reversed. In FIG. 24C, the blocks 312 have been rotated so that when they are operatively connected to the support beam 116 they are set back from the viewable surface 143. It will be appreciated that the blocks 312 need not be all coplanar or set back with respect to the viewable surface 143 of the support beam 116. Combinations of set backs and coplanar blocks are possible to create a myriad of wall surfaces. It is contemplated that such combinations may be arranged into identifiable forms or patterns and may also be arranged to display alphanumeric characters and the like. Note that the viewable surface 143 may be provided with a textured or otherwise decorated surface which matches the surfaces of adjacent blocks. Alternatively, as depicted in FIG. 24B, the viewable surface 143 of the support beam may be provided with a cap or strip 145 of material with a viewable surface 147 which may be textured or otherwise decorated as desired and which may be affixed or attached to the viewable surface 143 in a conventional manner.

It will be appreciated that the opposing, laterally extending, aligned fingers of the aforementioned blocks (312) may be aligned with the center plane of a block if desired. And, it will also be appreciated that wall structures other than linear structures are possible. For example, the support beams and blocks may be used to construct circular, or sinuous structures by providing curved blocks or blocks with one curved viewable surface (when viewed cross-sectionally from a point above the top surface of the block) that are operatively connected to support beams that are similarly arranged. Or, a wall structure may be constructed in a zigzag or erose form with the support beams collaterally arranged relative to each other in a zigzag manner. To reduce vertical gaps between forwardly facing viewable surfaces of adjacent blocks in such a wall structure, it would be a matter of providing support beams with ribs that are angled with respect to the web, mitering or beveling the opposing sides of the blocks, or using a combination of both angling and mitering the ribs and sides, respectively. A similarly configured wall may also be constructed using support beams arranged in a coplanar fashion relative to each other and blocks having a predetermined, angular viewable surface (when viewed cross-sectionally from a point above the top surface of the blocks). For example, a V, L, or a W. Such blocks may have parallel front and rear faces, if desired. With such a construction, neither the support beams nor the opposing fingers need to be modified. In a related construction, it is envisioned that blocks be constructed having angles of ninety degrees so that they may be used as inner or outer corners. With such blocks, the opposing sides and their fingers would be perpendicular to each other.

To construct a freestanding, low wall structure of the present invention, a person would prepare or otherwise select an appropriate location in which to construct a wall. The construction would begin by placing a first block having opposing side grooves in a desired position and orientation. Then, a second, similar block would be placed directly on top of the first block so that the opposing side grooves of the first and second blocks are in vertical alignment with each other and the first and second blocks form a column. Next, the first and second blocks would be operatively connected to each other along their respective sides by inserting at least one rib of first and second support beams into the aligned grooves of the respective sides of the first and second blocks and seating them securely. A second column comprising similarly configured third and a fourth blocks may now be constructed. The operation is much the same, except now the third block is positioned so that one of its sides is adjacent to one of the sides of the first block and its groove engages at least one other rib of one of the already positioned support beams. The fourth block is then positioned on top of the third block in a similar manner. That is, the fourth block is positioned so that one of its sides is adjacent to one of the sides of the second block and its groove engages at least one other rib of one of the already positioned support beam. After the second column is erected, the third and fourth blocks would be operatively connected to each other along their respective free side by inserting at least one rib of a third support beam into their aligned vertical groove of the respective sides of the first and second blocks and seating them securely. And so on.

Another preferred method of constructing a wall structure according to the present invention would be as follows. A person would prepare or otherwise select an appropriate substructure on which to construct a wall structure. The construction would begin by operatively connecting a first elongated support beam to the substructure in a vertical orientation. Then using the first support beam as a reference, a series of support beams would be operatively connected to the substructure, with all of the support beams in vertical and collateral alignment, and with the distance between adjacent support beams sufficient to enable the ribs of adjacent beams to engage opposing side grooves of a block. Once the dimensions of the wall structure have been established, the blocks with opposing side grooves may be laid by sliding the blocks in a vertical motion along the length of and between adjacent support beams. This may be done course by course, column by column, or in a mixture of both columns and courses, as desired.

In a variation of the aforementioned methods, the construction would begin by operatively connecting a first elongated support beam to the substructure in a vertical orientation. Then a first block having opposing side grooves would be placed in a desired position and orientation against the first elongate support beam so that at least one of the ribs of the first beam is seated within one of the side grooves of the block. Then, a second, similar block would be placed directly on top of the first block so that the at least one rib of the first beam is also seated within one of the side grooves of the second block so that the opposing side grooves of the first and second blocks are in vertical alignment with each other and the first and second blocks form a column. Next, the first and second blocks are operatively connected to each other along their other respective sides by aligning the grooves of the respective sides of the first and second blocks, and inserting at least one rib of a second support beam into the aligned grooves and seating it securely therein. After the second support beam is seated, it is attached to the substructure. A second column comprising similarly configured third and a fourth blocks may now be constructed. The operation is the same, with the third block positioned so that one of its sides is adjacent to one of the sides of the first block and its groove engages another rib of the already positioned second support beam. The fourth block is then positioned on top of the third block in a similar manner. That is, the fourth block is positioned so that one of its sides is adjacent to one of the sides of the second block and its groove engages another rib of the already positioned second support beam. After the second column is erected, the third and fourth blocks would be operatively connected to each other along their respective free side by aligning the grooves of the respective sides of the third and fourth blocks, and inserting at least one rib of a third support beam into the aligned grooves and seating it securely therein. After the third support beam is seated, it is attached to the substructure. And so on.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A beam for constructing a vertical wall structure having at least a first set of superposed blocks in substantial alignment, with each block including a front face, a rear face spaced from said front face by a distance defining the depth of the block, a top surface, a bottom surface spaced from said top surface by a distance defining the height of the block, and side surfaces spaced from each other by a distance defining the width of the block, with each side surface including a finger with opposing sides; the beam comprising:

an elongated web;

a first pair of laterally extending ribs constructed and arranged to operatively connect the first set of superposed blocks together in substantial vertical alignment as the ribs receive and frictionally grip the opposing sides of the fingers of the superposed blocks therebetween; and a second pair of laterally extending ribs constructed and arranged to operatively connect a second set of superposed blocks together in substantial vertical alignment as the ribs receive and frictionally grip the opposing sides of the fingers of the second set of superposed blocks therebetween.

2. The beam of claim 1, further comprising an attachment member, wherein the attachment member is configured to be operatively connected to a substructure.

3. The support beam of claim 1, wherein the ribs of the first pair of the ribs have different thicknesses.

4. The support beam of claim 1, wherein at least one of the first or second pairs of ribs further comprises a forwardly facing viewable surface.

5. The beam of claim 1, further comprising an attachment member, wherein the attachment member is configured to be operatively connected to a bracket and the bracket is configured to be operatively connected to a substructure.

6. A wall structure comprising at least two blocks stacked together, a peg, an elongated, vertically oriented support beam, and a web;

with each block including a front face, a rear face spaced a predetermined distance from said front face, a top surface, a bottom surface spaced a predetermined distance from said top surface; opposing side surfaces, and, a plurality of vertically oriented apertures extending inwardly from the top and bottom surfaces;

with the peg configured to be received within one of the plurality of apertures of adjacent courses of blocks and operatively connect the blocks together;

with the vertically oriented support beam operatively connected to a substructure; and, with the web operatively connecting the connected blocks to the support beam.

7. The block of claim 6, wherein the opposing side surfaces of each block further comprise a projection and a recess, respectively, wherein the projection and the recess are complimentarily shaped and configured to allow adjacent blocks in a course of blocks to be brought into alignment with each other as the horizontal distance between adjacent blocks is reduced.

8. The wall structure of claim 6, wherein each block has a preferred depth in the range of about 1 to 4 inches, a preferred height in the range of about 6 to 12 inches, and a preferred width in the range of about 6 to 24 inches.

9. The combination of an elongated vertically oriented support beam, a bracket, and a plurality of blocks, with each block having a rib engaging recess and with the plurality of blocks stacked upon each other in a self supporting column, with the elongated support beam comprising a web, a laterally extending rib, and an attachment member; and with the bracket comprising a substructure engaging portion and a support beam engaging portion; wherein the plurality of blocks are operatively connected to each other by the rib of the elongated, vertically oriented support beam as the rib engages the recesses of the stack of blocks; wherein the elongated, vertically oriented support beam is connected to the support beam engagement portion of the bracket by the attachment member of the support beam; and wherein the bracket is connected to a substructure to stabilize the plurality of stacked blocks so that the self supporting column formed thereby is able to resist forces that would normally be sufficient to cause the self supporting column to fail.

10. A device for use in supporting a wall structure of the type having a plurality of blocks stacked in columnar fashion with adjacent columns of blocks operatively connected to each other by a plurality of elongated, vertically oriented support beams, with at least one of the support beams including an attachment member; the device comprising;

an elongated, vertically oriented post having a vertically oriented bracket extending therefrom, with the bracket configured to operatively engage an attachment member of an elongated vertically oriented support beam; wherein a wall structure may be operatively connected to the device in a supporting relation.

11. A method of assembling and connecting a wall to an existing structure, the method comprising the steps of:

a. providing a plurality of masonry blocks, with each masonry block comprising: a front face, a rear face spaced from said front face by a distance defining the depth of the block; a top surface; a bottom surface spaced from said top surface by a distance defining the height of the block; side surfaces spaced from each other by a distance defining the width of the block, with each of the side surface including a rib receiving recess;

b. providing a plurality of elongated support beams, with each support beam comprising: an attachment member, an elongated web connected thereto, and at least one pair of ribs extending laterally therefrom in opposite directions;

c. connecting a first elongated support beam to the existing structure using the attachment member of the support beam such that the support beam is in a generally vertical orientation;

d. positioning a first block adjacent the beam so that the rib receiving recess of one side of the block engages a portion of the rib of the first support beam;

e. positioning a second block on top of the first block in a columnar fashion so that the rib receiving recess of one side of the second block is adjacent to and engages another portion of the rib of the first support beam; and f. connecting a second support beam to the existing structure using the attachment member of the support beam such that the support beam is positioned adjacent unengaged sides of the first and second blocks and portions of the rib of the second support beam engage both of the rib receiving recesses of the first and second blocks and complete the wall.

12. A wall structure comprising:

at least two blocks arranged in a substantially superposed, freestanding vertical relation, with each block comprising;

a front face:

a rear face spaced from said front face by a distance defining the depth of the block;

a top surface;

a bottom surface spaced from said top surface by a distance defining the height of the block;

side surfaces spaced from each other by a distance defining the width of the block, with at least one side surface including a finger with opposing sides; and, a beam comprising:

an elongated web having at least one pair of ribs extending laterally therefrom;

wherein the beam is configured to be positioned close enough to the side surfaces of the superposed blocks so that the ribs frictionally receive and grip the opposing sides of the fingers of the superposed blocks therebetween;

whereby the blocks may be operatively connected to each other to form the wall structure.

13. The block of claim 12, wherein each said finger is substantially coextensive with each respective side surface.

14. The block of claim 12, wherein the front face and the rear face have different, integrally formed surface textures.

15. The wall structure of claim 12, wherein the beam further comprises an attachment member, wherein the attachment member is configured to be operatively connected to a substructure.

16. The wall structure of claim 12, further comprising a bracket, wherein the beam is configured to be operatively connected to the bracket and the bracket is configured to be operatively connected to a substructure.

17. The wall structure of claim 12, wherein each of the blocks has a preferred depth in the range of about 1 to 4 inches, a preferred height in the range of about 6 to 12 inches, and a preferred width in the range of about 6 to 24 inches.

18. The wall structure of claim 12, wherein each side surface of each block comprises two substantially parallel fingers, with each pair of fingers configured to receive a portion of the beam therebetween.

19. The block of claim 18, wherein at least one pair of fingers is substantially coextensive with one of said side surfaces.

20. The block of claim 18, wherein the front face and the rear face have different, integrally formed surface textures.

21. The wall structure of claim 18, wherein each of the blocks has a preferred depth in the range of about 1 to 4 inches, a preferred height in the range of about 6 to 12 inches, and a preferred width in the range of about 6 to 24 inches.

22. A wall structure comprising:

at least two blocks arranged in a columnar relation with each block including a front face, a rear face spaced from said front face, a top surface, a bottom surface spaced from said top surface, and first and second side surfaces, with at least one of the first or second side surfaces including a support beam engagement portion;

at least one support beam having a longitudinal extent, the support beam having a web, at least one pair of laterally extending, generally parallel ribs; and, an elongated bracket having a longitudinal extend that is greater than the longitudinal extent of the support beam;

wherein the support beam is configured to be positioned along the first side surfaces of the blocks to operatively connect the blocks together in a columnar relation;

wherein the attachment member is configured to be operatively connected to the elongated bracket; and, wherein the elongated bracket is configured to be operatively connected to a substructure.

23. A beam for use in constructing a vertical wall structure having at least a first set of superposed blocks in substantial alignment, with each block including a front face, a rear face spaced from said front face by a distance defining the depth of the block, a top surface, a bottom surface spaced from said top surface by a distance defining the height of the block, and side surfaces spaced from each other by a distance defining the width of the block, with each side surface including a finger; the beam comprising:

an elongated web;

a first pair of laterally extending, ribs having different effective thicknesses, the ribs constructed and arranged to operatively connect the first set of superposed blocks together in substantial vertical alignment as the ribs receive and frictionally engage the fingers of the superposed blocks therebetween.

24. The beam of claim 23, further comprising an attachment member, wherein the attachment member is configured to be operatively connected to a substructure.

25. The beam of claim 23, further comprising an attachment member, wherein the attachment member is configured to be operatively connected to a bracket and the bracket is configured to be operatively connected to a substructure.

* * * * *